US008807417B2

(12) United States Patent
Valesini Gegembauer

(10) Patent No.: US 8,807,417 B2
(45) Date of Patent: Aug. 19, 2014

(54) ARTICULABLE STRUCTURE IN THE FORM OF A FRACTAL

(75) Inventor: Luis Antônio Valesini Gegembauer, Rio de Janeiro (BR)

(73) Assignee: Arak-Idea Serviços de Design e Patentes Ltda., Rio de Janeiro RJ (BR)

( * ) Notice: Subject to any disclaimer, the term of this patent is extended or adjusted under 35 U.S.C. 154(b) by 0 days.

(21) Appl. No.: 13/884,596

(22) PCT Filed: Nov. 10, 2011

(86) PCT No.: PCT/BR2011/000418

§ 371 (c)(1),
(2), (4) Date: Jun. 17, 2013

(87) PCT Pub. No.: WO2012/061915

PCT Pub. Date: May 18, 2012

(65) Prior Publication Data

US 2014/0001247 A1 Jan. 2, 2014

(30) Foreign Application Priority Data

Nov. 10, 2010 (BR) ..... 1004589

(51) Int. Cl.
*B65D 5/24* (2006.01)
*B65D 5/488* (2006.01)

(52) U.S. Cl.
USPC ..... 229/116.1; D9/433; D9/756; 206/594; 229/120.12; 229/120.18

(58) Field of Classification Search
USPC ..... 229/108, 116.1, 120.12, 120.18, 229/120.35, 120.37; 206/591–594; D9/432, D9/433, 737, 756
See application file for complete search history.

(56) References Cited

U.S. PATENT DOCUMENTS 1,292,188 A * 1/1919 Wheeler ..... 229/108
2,050,894 A * 8/1936 Paige ..... 229/116.1

(Continued)

FOREIGN PATENT DOCUMENTS

CN 201633985 U 11/2010
GB 2467995 A 8/2010

OTHER PUBLICATIONS

The International Bureau of WIPO, International Preliminary Report on Patentability (Translation of Written Opinion) for International Application No. PCT/BR2011/000418, mailed May 23, 2013, 11 pages, Switzerland.

(Continued)

*Primary Examiner* — Gary Elkins
(74) *Attorney, Agent, or Firm* — Alston & Bird LLP

(57) ABSTRACT

The present invention relates to an articulable structure in fractal form, comprising at least one external compartment (CE) and at least a first internal compartment (Cu) that are linked together in an articulated manner via at least one of the edges thereof, the at least two compartments (CE and Cu) essentially having the same format in the erected and flat states and the first internal compartment has smaller dimensions than the external compartment, the first internal compartment, in the erected state, being accommodated inside the external compartment, and each compartment has a polygonal format, comprising at least four lateral faces (FL) and a bottom face (FF); each compartment of the articulable structure comprises at least five quadrangular faces corresponding to the four lateral faces (FL) and to the bottom face (FF), each edge of the bottom face (FF) being linked in an articulated manner to a lower edge of the same size of one of the lateral faces (FL), and at least four identical triangular faces (T) in the form of a right-angled isosceles triangle, each triangular face (T) connecting adjacent lateral faces, with each edge corresponding to a vertical height of the triangle, being linked in an articulated manner to a lateral edge of one of the adjacent lateral faces (FL) and the edge corresponding to the hypotenuse linking the vertices of the two adjacent lateral faces, wherein the length of the hypotenuse edge of the triangular faces (T) of the first internal compartment (Cu) is equal to or less than the length of the upper edge of the lateral faces (FL) of the external compartment (CE). This structure allows the use of countless compartments arranged one inside another in succession and that may be articulated together in different ways, achieving one and the same final format.

17 Claims, 23 Drawing Sheets

(56) References Cited

U.S. PATENT DOCUMENTS

| | | | | | |
|---|---|---|---|---|---|
| RE23,670 | E | * | 6/1953 | Currivan | 229/120.18 |
| 2,828,902 | A | * | 4/1958 | Ringler | 206/594 |
| 3,232,513 | A | * | 2/1966 | Maio | 206/591 |
| 3,880,342 | A | * | 4/1975 | Longo, Jr. | 229/108 |
| D264,688 | S | * | 6/1982 | Austin | D9/433 |
| 4,871,080 | A | * | 10/1989 | Bennett | 229/108 |
| D311,337 | S | * | 10/1990 | Rigby | D9/433 |
| 5,076,793 | A | * | 12/1991 | Aghevli et al. | 434/196 |
| 5,332,148 | A | * | 7/1994 | Liu et al. | 229/120.12 |
| 5,597,112 | A | * | 1/1997 | Knapp | 229/116.1 |
| D436,315 | S | * | 1/2001 | Bentolila | D9/433 |
| 6,244,501 | B1 | * | 6/2001 | Choi | 229/116.1 |
| 8,162,205 | B2 | * | 4/2012 | Stephens | 229/116.1 |
| D693,675 | S | * | 11/2013 | Staller | D9/433 |
| 2006/0289614 | A1 | * | 12/2006 | Posselt | 229/116.1 |

OTHER PUBLICATIONS

National Institute of Industrial Property, International Search Report (ISR) and Written Opinion for International Application No. PCT/BR2011/000418, mailed Feb. 1, 2012, 17 pages, Brazil.

* cited by examiner

FIG. 5A
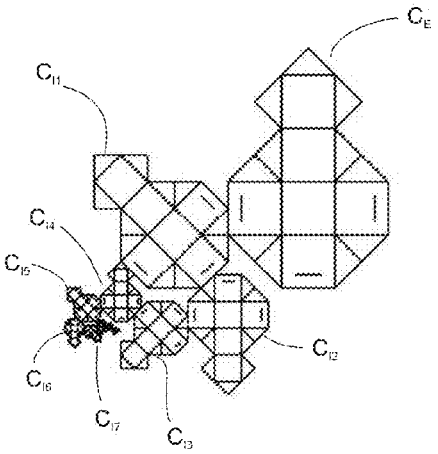
FIG. 5B
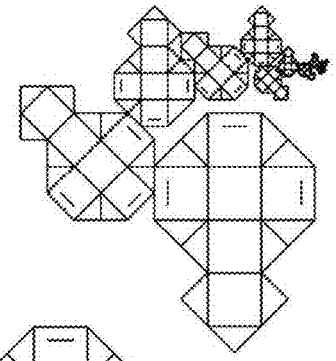
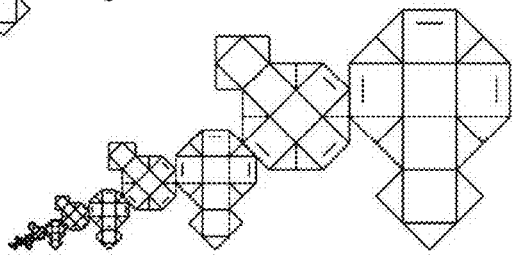
Fig. 5C
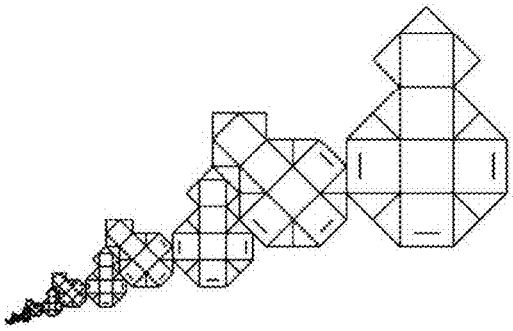
FIG. 5D
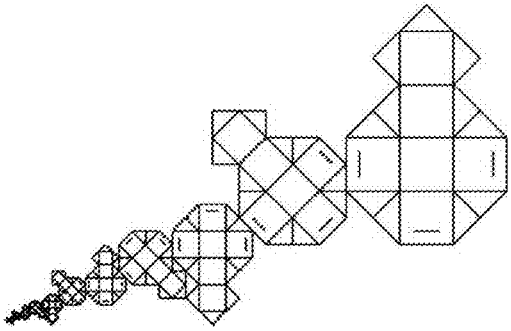
FIG. 5E FIG. 10A
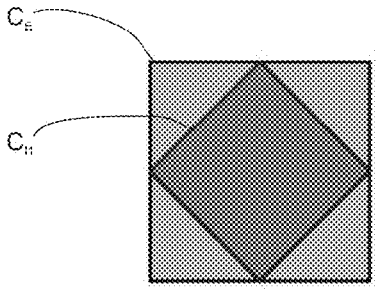
FIG. 10B
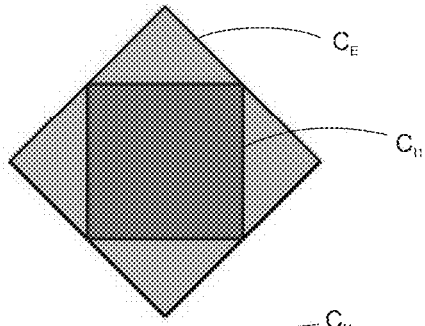
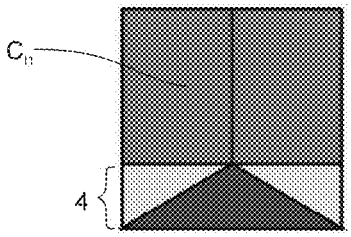
FIG. 11A
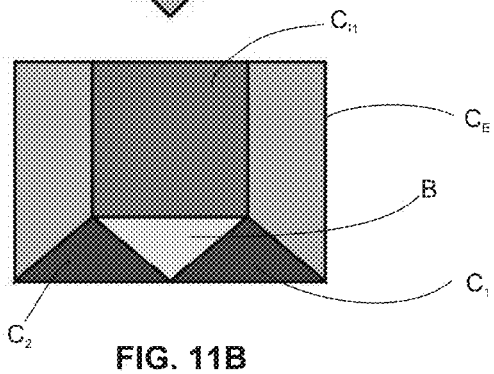
FIG. 11B
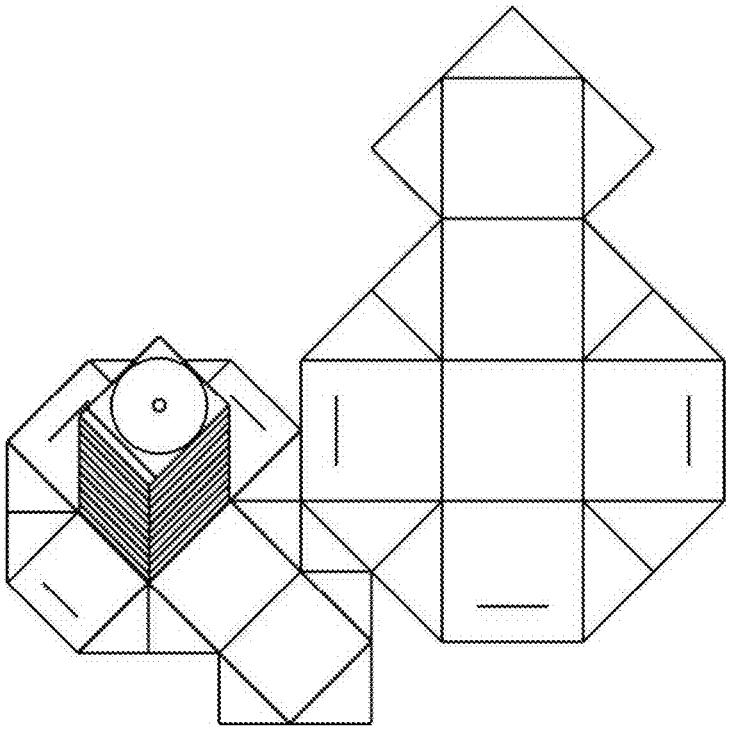
FIG. 12

FIG. 24A
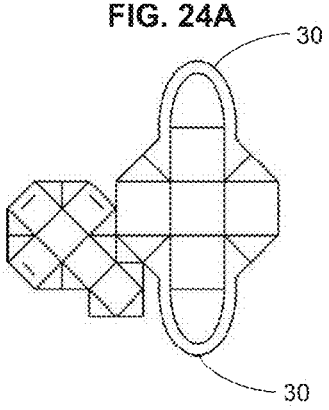
FIG. 24B
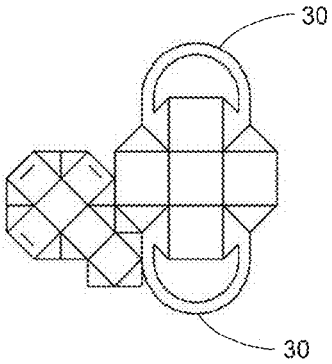
FIG. 24C
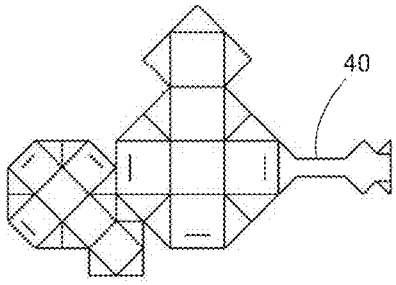
FIG. 24D
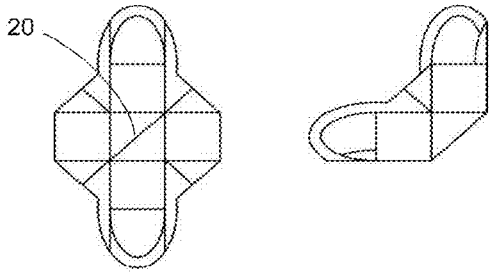
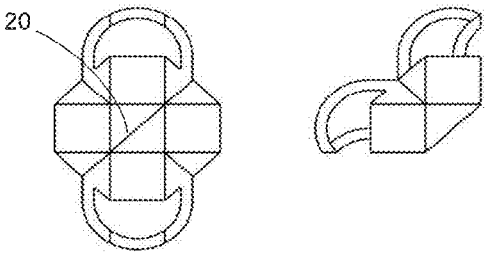
FIG. 24E

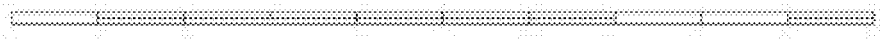
FIG. 27C
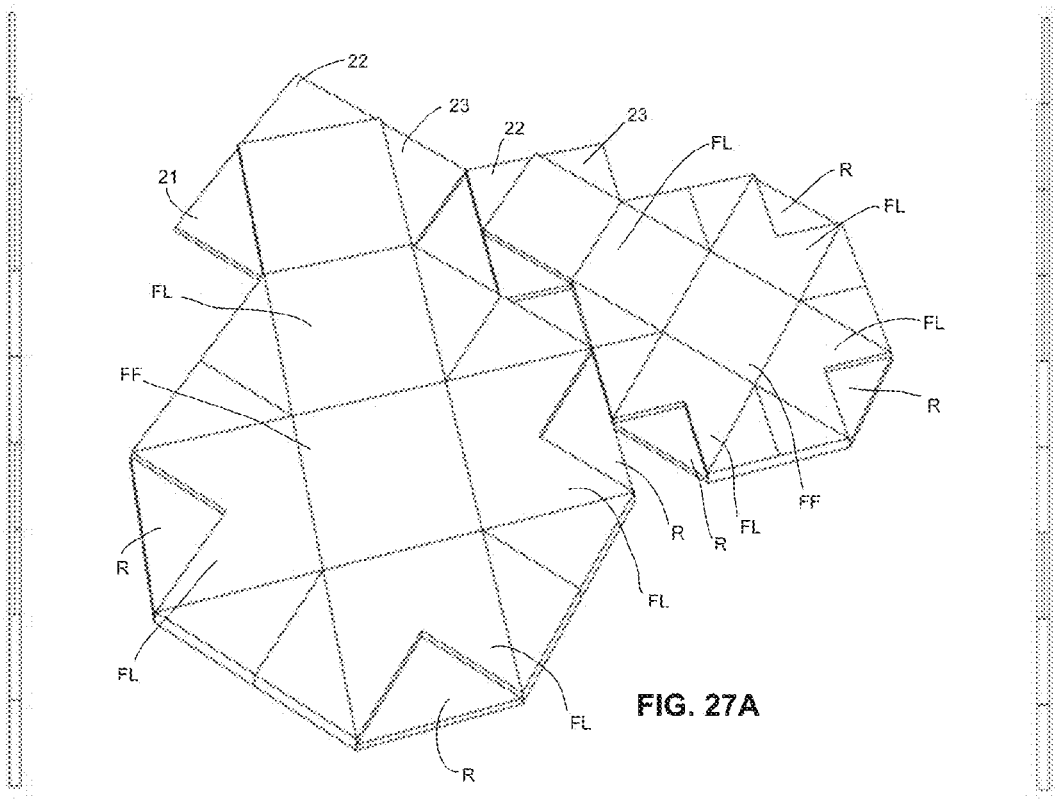
FIG. 27A
FIG. 27B
FIG. 27D
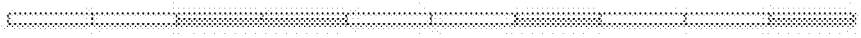
FIG. 27E

ARTICULABLE STRUCTURE IN THE FORM OF A FRACTAL

CROSS REFERENCE TO RELATED APPLICATIONS

This application is a national stage application, filed under 35 U.S.C. §371, of International Application No. PCT/BR2011/000418, filed Nov. 10, 2011, which claims priority to and the benefit of Brazilian Application No. PI1004589-9, filed Nov. 10, 2010, the contents of both of which are hereby incorporated by reference in their entirety.

BACKGROUND OF THE INVENTION

1. Related Field

The present invention relates to an articulable structure in the form of a fractal of polygonal borders, which can hold a number of internal compartments arranged inside each other successively, which imparts greater resistance and protection to the assembly, providing the invention with numberless functionalities and applications, chiefly as a package, enabling it to be reused, thereby preventing disposure of material.

2. Description of Related Art

A few packages are already known from the prior art, which can be assembled by folding, thus providing the user with a playful application, and also having a remarkable esthetic presentation. Some of these packages aim at saving and optimizing space in the package.

Toys assembled by folding cardboard, such as origami, are also known. These toys may be merely the object of entertainment, or may have educational features, helping children to develop the perception of volumes, tree-dimensional forms, and even aiding in the development of manual skills in paper folding, or still in making folded pieces having compatible shapes that enable mutual engagement.

None of the prior-art packages is capable of achieving these objectives at the same time, being also adaptable for different types of object, having variable capacity and also providing other uses besides merely functioning as a package, such as toys, games, calculator, book, wall clock, objects for teaching mathematics, key-holder, portrait holder, piece of furniture, among others. This use of the package has a further ecological feature, namely it prevents the disposal of material and, at the same time, becomes an additional attraction for consuming such a package.

Fractals, in turn, are complex geometric figures, the form of which recurring indefinitely in different sizes, while usually keeping the same internal proportions. Fractals are observed in some aspects of nature, such as the shape of determined leaves, branches of trees or still molecular structures, among others. They are usually formed by iterative processes by rotations, translations and reductions of geometric figures, for instance. Due to the very peculiar characteristics of fractals, they are used in various branches of science, such as biology, geology, biochemistry, geography, image processing and mathematic modeling. However, one has never thought of the application of fractals in making packages.

BRIEF SUMMARY

It is an objective of the invention to provide a package assembled by folding and that can be employed by the user as an article having other functionalities than the mere carrying products, preventing disposal of material and providing the articulable structure in the form of a fractal with additional attraction.

It is a further objective of the invention to provide an articulable structure in the form of a fractal, which occupies little physical space in its assembled state, but is, at the same time, entirely compartmented, thus enabling better use of its volume.

It is also an objective of the invention to provide an object that can be opened in a unique and differentiated manner, which imparts value to the presentation of the product and causes impact on the receiver thereof.

Another objective of the invention is to provide an object that, besides holding a product, can provide functionality of its inner and outer faces.

It is also an objective of the invention to provide an articulable object that has the structure of a fractal, while providing educational aid to the users.

In addition, it is also an objective of the invention to provide an articulable structure that can be used for forming packages that provide greater protection to its contents, absorbing greater impacts, better distributing the force that is directed to it than traditional packages.

Finally, it is also an objective of the invention to create a delineated and articulable geometric structure that can be assembled and applied as a structural part of objects of different shapes and types, with the aid of a folding and space-optimization system.

BRIEF DESCRIPTION OF THE FIGURES

The present invention will be, as follows, described in more details based on one execution example represented in the drawings. The figures show:

FIG. 5A, 5B, 5C, 5D, 5E, 5F, 5G are top views of the articulable structure according to the invention with different delineations, showing alternative forms of composition of the structure shown in FIG. 1 ion the delineated position;

FIG. 8 is a top view of third embodiment of the structure according to the invention in the delineated position, wherein the base face is bored through;

FIGS. 10A and 10B are horizontal cross-sectional view of the structure shown in FIG. 9 in the assembled position;

FIGS. 11A and 11B are cross-sectional view of the structure assembled in FIGS. 10A and 10B, respectively;

FIG. 12 is a top view of fifth embodiment of the articulable structure in the form of a fractal according to the invention in the delineated position, storing a stack of CD's in its internal compartment;

FIGS. 24A to 24C show the structure of the present invention using different types of straps;

FIGS. 24D and 24E show the steps of assembling the structure of the present invention using straps;

FIGS. 27A to 27E show an embodiment of the structure of the present invention in which the structure faces are made with other thickness than that of the flaps;

DETAILED DESCRIPTION OF VARIOUS EMBODIMENTS

Figure 1:
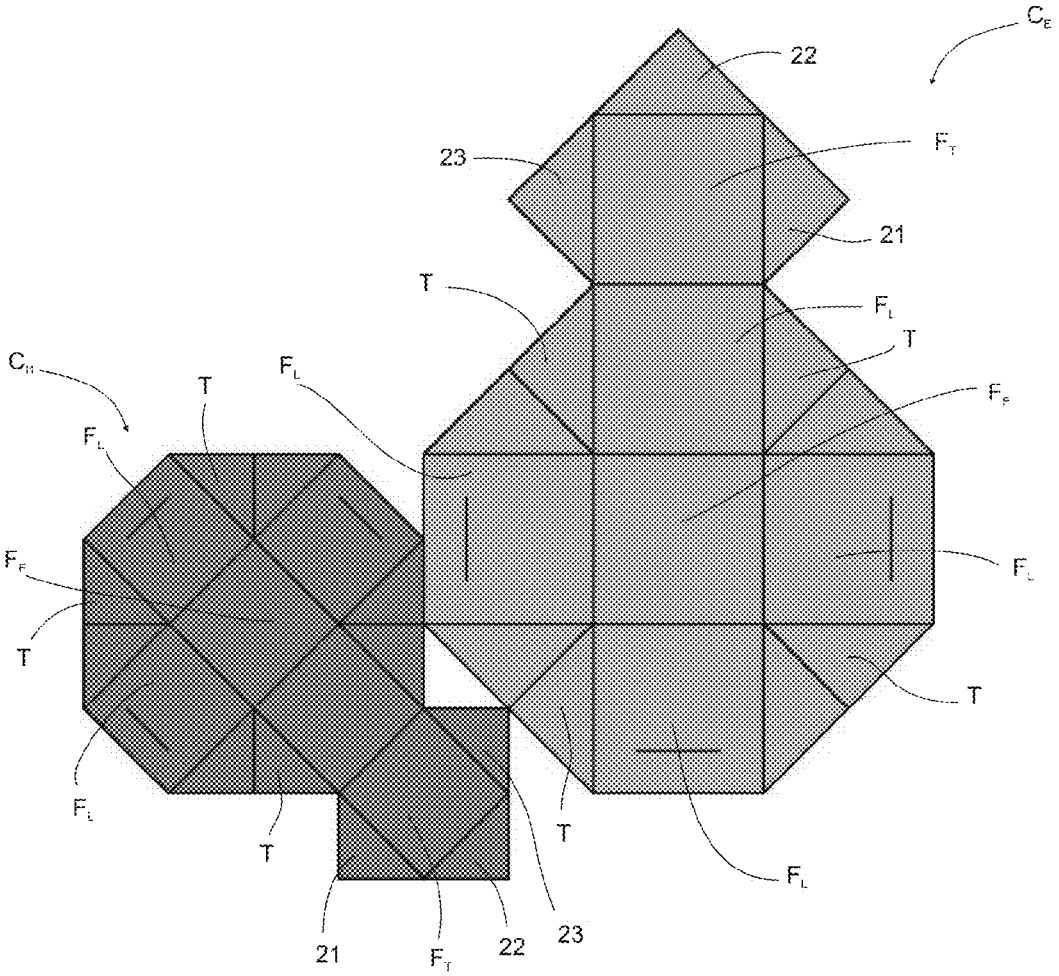
FIG. 1 is a top view of first embodiment of the articulable structure in the form of a fractal of the present invention in the delineated position, having only one internal compartment and one external compartment.

FIG. 1 shows first embodiment of the articulable structure of the present invention, the delineated shape of which is based on fractals. In FIG. 1, the articulable structure is shown in its delineated state. This articulable structure comprises an external compartment $C_E$ and first internal compartment $C_{I1}$, which are linked together with articulation by at least one of their borders. As shown in the figure, the two compartments have exactly the same shape in the delineated state, open. However, the internal compartment $C_{I1}$ has smaller dimensions than the external compartment $C_E$, so that, in the assembled state, this internal compartment will be housed within the external compartment.

Figure 7:
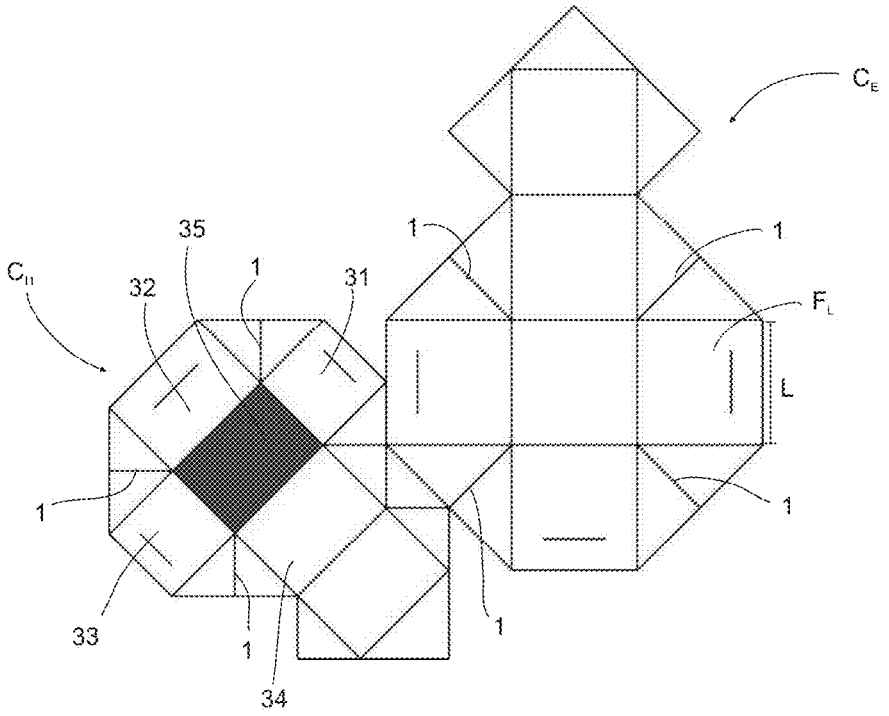
FIG. 7 is a top view of second embodiment of the articulable structure in the form of a fractal according to the invention in the delineated position, having only one internal compartment in the form of a parallelepiped.

The internal and external compartment, in the assembled state, have a polygonal shape, preferably a cubic shape, as shown in FIG. 1. The internal compartment may be in the form of a parallelepiped, as shown in FIG. 7. The internal and external compartments comprise fourth side faces FL and one bottom face FF.

Preferably, the external and internal compartments also comprise a cover face FT, but this face is not essential to all the embodiments of the articulable structure according to the invention. There is the possibility that only the internal compartment or the external compartment will have a cover face, or neither of them may have a cover face (embodiment of the invention that is not illustrated). When it comes to the application of the articulable structure as a package, it is advantageous that the compartments should have this cover face FT, since it enables the package in the form of a cube to be assembled, resisting the natural tendency to open. In case this cover face is not used, it is necessary to use another means to keep the side faces together, such as gluing, welding, a Velcro system, magnets, snap fitting, among others.

Side faces FL, bottom face FF and cover face FT have a quadrangular shape, which may be square or rectangular. In most embodiments of the invention, for instance, those shown in FIGS. 1 to 6, the side face, bottom face and cover face are square and identical. In the external and internal compartments, each border of the bottom face FF is lined with articulation to a lower border of the same dimension as one of the side faces FL, as shown in FIG. 1. This enables the side faces to be folded upward or downward in the directions of the arrows shown in FIGS. 3 and 4, forming right angle with the bottom face FF and with the neighboring side faces, while the compartments are being assembled.

The external and internal compartments further have four equal triangular faces T in the form of an isosceles right-angled triangle. Each of the triangle faces T connects two side faces FL. For this purpose, each border corresponding to a cathetus of the triangular face T is lined in articulation to a side border of one of the neighboring side faces FL. Besides, the border corresponding to the hypotenuse of the triangular face T links the vertices of the two neighboring side faces FL.

In the preferred embodiments of the invention, in which one wishes to achieve greater utilization of the internal space of the structure in the assembled position, the dimensions of the faces of the internal and external compartments should meet determined proportions presented hereinafter. However, the structure of the present invention may have internal compartments with smaller dimensions than those of maximum value, which still enable a more internal compartment to be housed within it.

Figure 2A:
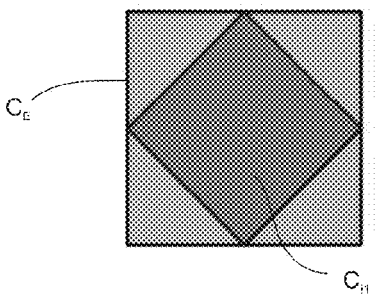
FIG. 2A is a horizontal cross-sectional view of the structure shown in FIG. 1 in the assembled position.
Figure 2B:
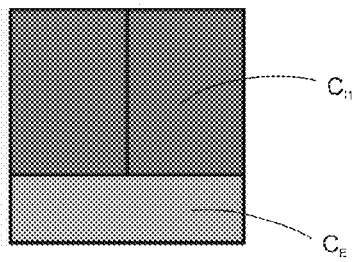
FIG. 2B is a cross-sectional view of the structure shown in FIG. 2A.
Figure 3:
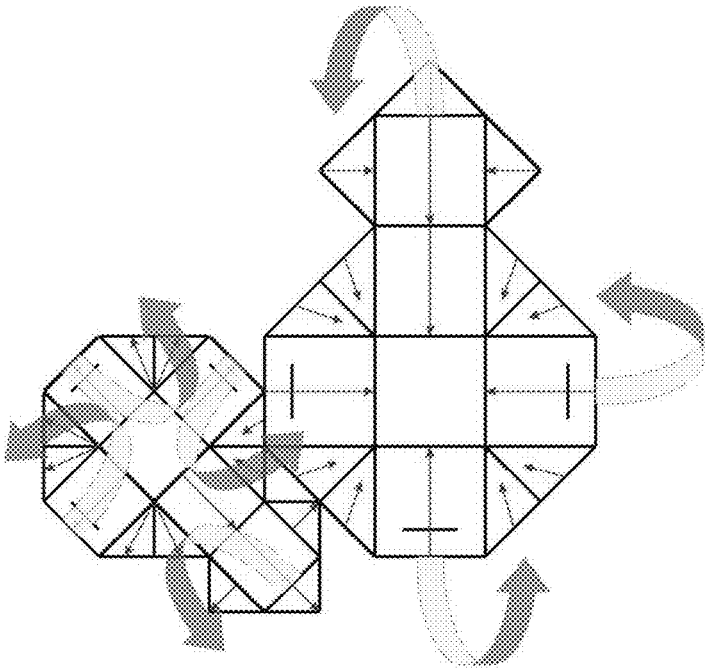
FIG. 3 is a top view of the structure shown in FIG. 1, with arrows indicating first possibility of folding directions of each of its parts, in order to put the structure in assembled state.
Figure 4:
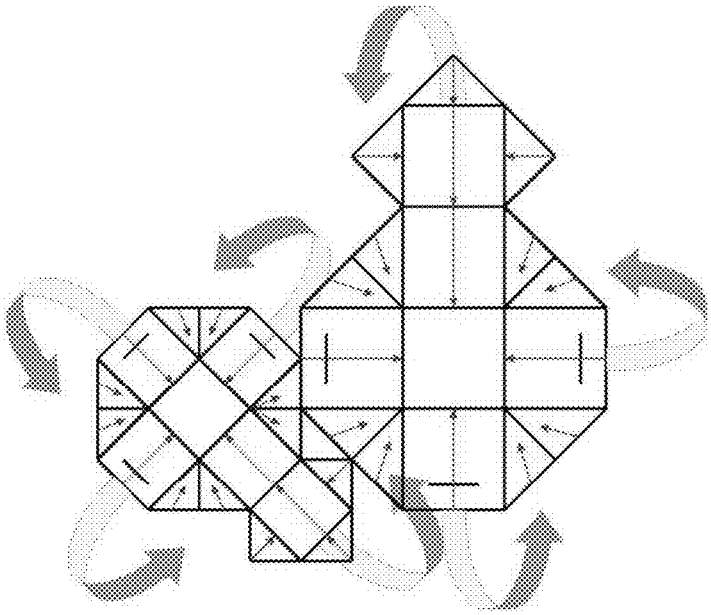
FIG. 4 is a top view of the structure shown in FIG. 1, with arrows indicating second possibility of folding directions of each of its parts, to put the structure in assembled state.
Figure 5F:
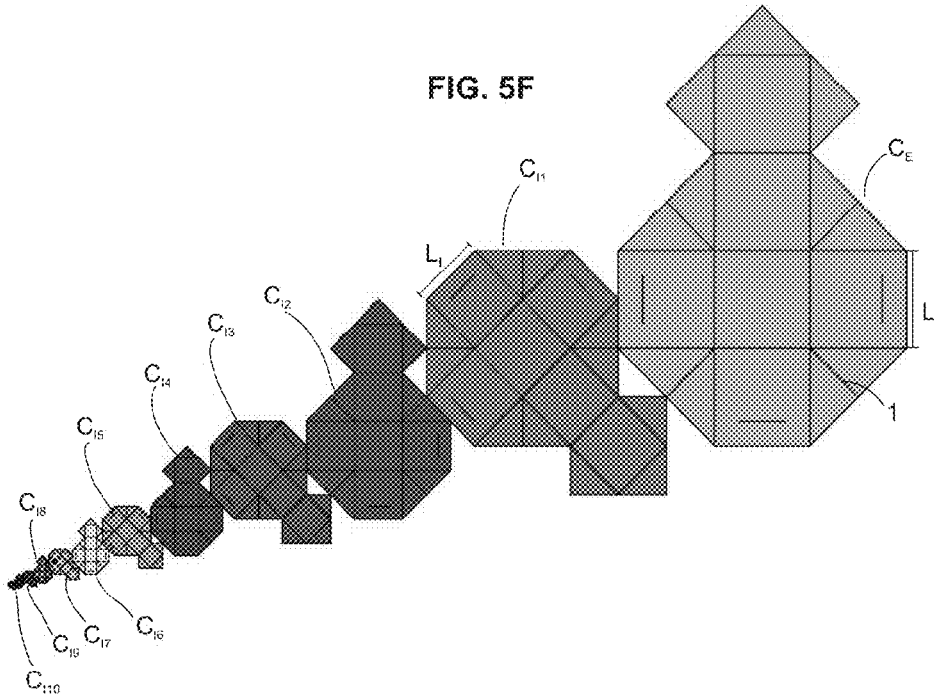
Figure 5G:
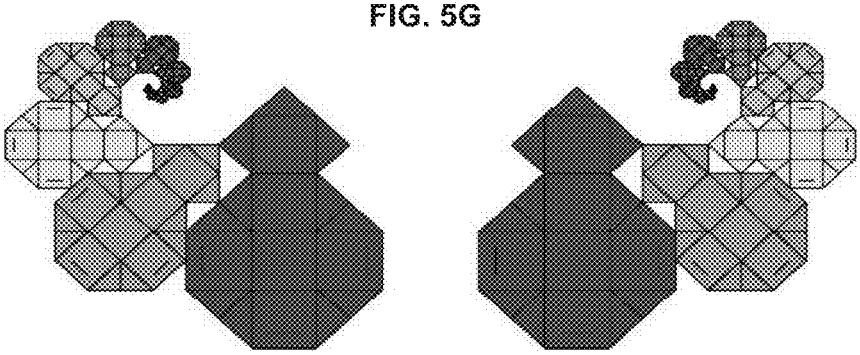

As one can see, for instance, in FIGS. 1 to 5G, the length of the hypotenuse border of the triangular faces of the first internal compartment $C_{I1}$ is equal to or shorter than the length of the upper border of the side faces FL of the internal compartment, so that the internal compartment $C_{I1}$ can fit into the external compartment $C_E$ in an arrangement displaced by 45° with respect to the external compartment, as shown in FIG. 2A. As one can also understand with the aid of FIG. 5F, which illustrates a similar embodiment of the invention, the hypotenuse border of the triangular face of the internal compartment $C_{I1}$ is equal to the length L of the upper border of the side faces FL of the external compartment. As a result, since the side faces FL of the internal compartment $C_{I1}$ have a height that is equal to the catheti of its triangular faces T, then the height of these side faces will be equal to a $$\frac{L}{\sqrt{2}}.$$

In the embodiment of the invention shown, for instance, in FIGS. 1, 2, 5A to 5G, among others, the side faces of the innermost compartment are all equal, so that the internal compartment is housed more tightly within the external compartment, as shown in FIGS. 2A and 2B. On the other hand, in the case of FIG. 7, which shows the rectangular internal compartment, the side faces 31, 32, 33, 34 of the internal compartment should have dimensions that follow the rectangular shape of the bottom face 35 of the internal compartment. Then two diametrically opposed side faces 31, 33 have a square shape with all the sides having a length equal to $$\frac{L}{\sqrt{2}},$$

(L being the length of the border of the side faces FL of the external compartment), while two side faces 32, 34 have rectangular shape, the smaller side (height) of which meets the relationship $$\frac{L}{\sqrt{2}},$$

while the longer side (width) is equal to the width of the bottom face 35 of the internal compartment.

Figure 28:
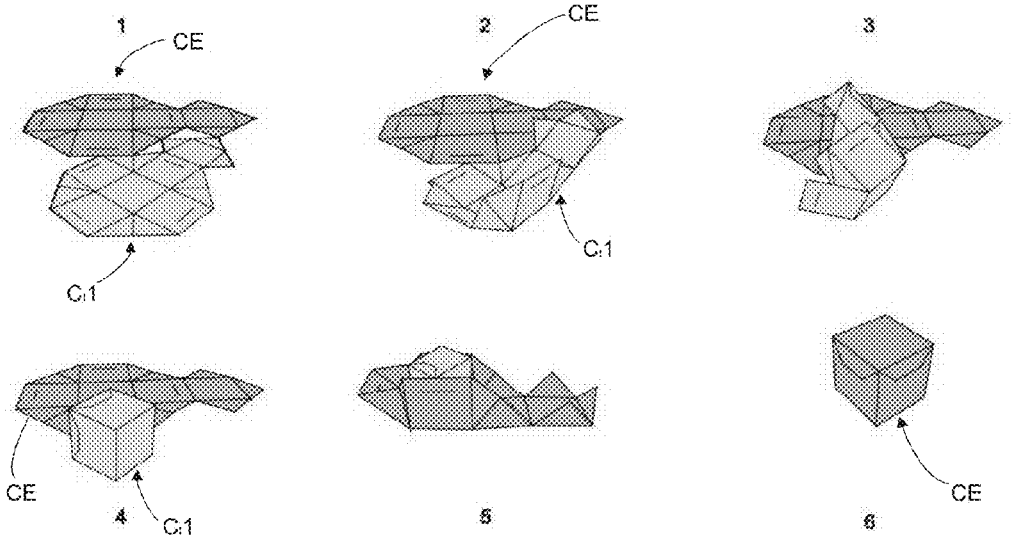
FIG. 28 show a sequence of perspective views illustrating the assembling of the smaller structure and then the larger structure.
Figure 29:
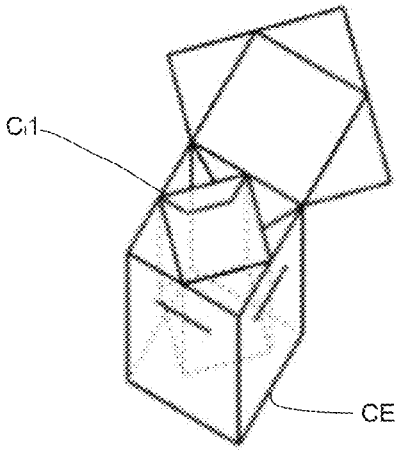
FIG. 29 shows the smaller compartment housed within the larger compartment, when the two compartments are in the assembled position.
Figure 30:
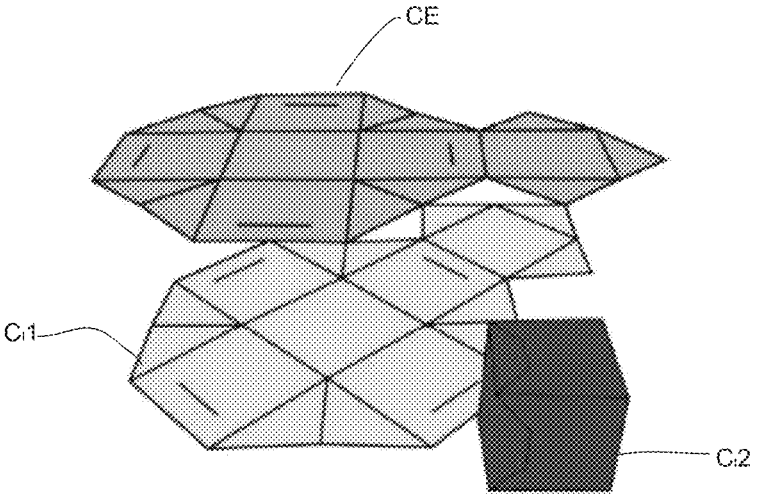
FIG. 30 shows an embodiment of the structure with three compartments, only one of which is assembled.

One can also notice, in FIGS. 1 to 7, the half the length of the hypotenuse border of a triangular face T of the first internal compartment $C_{I1}$ should be connected articulately to the half of the length of the upper border of a side face FL of the external length $C_E$. This connection between the compartments enable that, upon assembly of the structure according to folds shown in FIGS. 3, 4, and 28, the shorter length will be housed within the larger compartment with the desired orientation displaced by 45°. In some applications of the invention, particularly when it is used as a package, the latter arrangement will impart greater resistance to the assembly, as the outer box face begins to be supported by the edge of the inner box exactly in the weakest area, which is the middle of this face, imparting greater protection to the product that is within the innermost box. FIG. 28 illustrates the sequence of steps for folding a package according to the invention containing a smaller internal compartment $C_{I1}$ and a larger external compartment CE, so that the smaller compartment $C_{I1}$ will be housed within the larger compartment CE when the package is in its completely assembled state. FIG. 29 shows, in a schematic view, how the smaller compartment is housed within the larger compartment when the two compartments are in the assembled position. FIG. 30 shows an embodiment of the structure with three compartments, wherein only the smaller compartment $C_{I2}$ is in the assembled state. The medium compartment $C_{I1}$ and larger compartment $C_E$ are shown in the delineated position. In order to assemble the 3-compartment structure, it is enough to follow the steps shown in FIG. 28, until all the compartments are in assembled position and the smaller compartment $C_{I2}$ is housed within the middle compartment $C_{I1}$, and the latter within the larger compartment $C_E$.

It is also desirable that each triangular face T of each internal or external compartment of the package should have a central articulation 1 in the bisectrix ling of its right angle. When the structure according to the invention is made from paper, this articulation 1 may be in the form of a fold or crease in said bisectrix line of the triangular face, dividing it by half into two equal smaller right-angled triangles. This fold enables the triangular face T to be folded inwards of the respective compartment upon assembling the structure as a package in the form of a cube, causing two neighboring side faces FL connected by the triangular face T to rest on each other, forming a right angle when they are put in the vertical position, also forming a rectangle with the bottom face FF.

As already mentioned, in the embodiments of the invention illustrated in the figures, each internal or external compartment of the package further comprises a cover face FT, which consists of a sixth quadrangular face having the same dimensions as the bottom face FF. The cover face FT has a border connected articulately with an upper border of one of the free side faces FL, as shown clearly in FIGS. 1, 3 and 4, which show the package in the open state. The cover face FT of each compartment is connected articulately, at each of its three free borders, to a preferably triangular flap 21, 22, 23, more preferably in the form of an isosceles right-angled triangle. This flap may also exhibit other shapes, for example trapezoidal, circular, among others, as long as it performs the adequate closing function. The side corresponding to the hypotenuse of each triangular flap 21, 22, 23 is connected to the cover face. Preferably, the two catheti of the triangular flap 22 opposite the border connected to the side face FL are linked, in a straight line, to one cathetus of the neighboring triangular flaps 21 and 23. This arrangement facilitates the manufacture of the package in a single piece, since the cover in open state has the approximate shape of a square, which makes the cutting of the paper piece simple. The triangular flaps 21, 22, 23 serve to fit into the cutting line border parallel to the upper border of three of the four faces FL of the respective compartment, close to the side faces FL, to guarantee and aiding in closing the package.

One can observe that the internal, smaller, compartment, and the external, larger compartment have the same geometric shape and form a sort of fractal.

In the embodiment of the invention illustrated in FIGS. 5A, 5B, 5C, 5D, 5E, 5F and 5G, the package has a plurality of internal compartments, all of them with the same shape as the external compartment in the open state, characterizing even more the application of fractals, since there is a repetition N times of the same geometric shape in smaller and smaller proportions, wherein N may vary from 1 to any positive integer and corresponds to the number of internal compartments $_{CI1}$, $_{CI2}$, $C_{I3}$, . . . $C_{IN}$ of the package. The compartment $C_{I1}$ is the largest internal compartment, being immediately smaller than the external compartment. Preferably, the internal compartment has dimensions corresponding to 70.75% of the size of CE, the dimensions of the internal compartments becoming progressively smaller in this proportion as N increases, so that the internal compartment $C_{IN}$ is the smallest and innermost one when the package is assembled. In the assembled state, each internal compartment $C_{IN}$ is housed inside the immediately larger internal compartment $C_{I(N-1)}$. Each internal compartment $C_{IN}$ has the same shape as the immediately larger internal compartment $C_{I(N-1)}$ in the assembled state. The use of internal compartments $C_{I(N-1)}$ with dimensions corresponding to 70.75% of the dimensions of its immediately compartment ($C_{IN}$ o or $C_E$) enables the edges of the innermost compartment, in the assembled state, to touch the side faces FL of the outermost compartment, giving greater resistance to the structures and preventing the internal compartment(s) from being loosen.

FIGS. 5A, 5B, 5C, 5D, 5E, 5F and 5G shows that the delineated structure may be constructed with the internal compartment being arranged in various ways with respect to each other. However, in spite of the manner in which the compartments are arranged with respect to each other, when the structures according to any of FIGS. 5A, 5B, 5C, 5D, 5E, 5F and 5G are assembled, they will have the same shape and appearance, and all their compartments will be arranged at 45 degrees with respect to the compartment that is immediately larger and the one that is immediately smaller.

In this embodiment of the invention, the proportion between the dimensions of the internal compartment and the external compartments should meet the specific mathematic relations, so as to enable one to be housed within the other, also characterizing the fractal composition. The length of the hypotenuse of the triangular faces T of an internal compartment $C_{IN}$ should be equal to or shorter than the length of the upper border of the side faces FL of the larger internal compartment $C_{I(N-1)}$, similarly to the proportion between the external compartment $C_E$ and the first internal compartment $C_{I1}$. In the same way, half of the hypotenuse of a triangular face T of the internal compartment $C_{IN}$ is articulately connected, for instance, by means of a fold, to the half of the length of the upper border of a side face of the immediately larger internal compartment $C_{I(N-1)}$.

Figure 6:
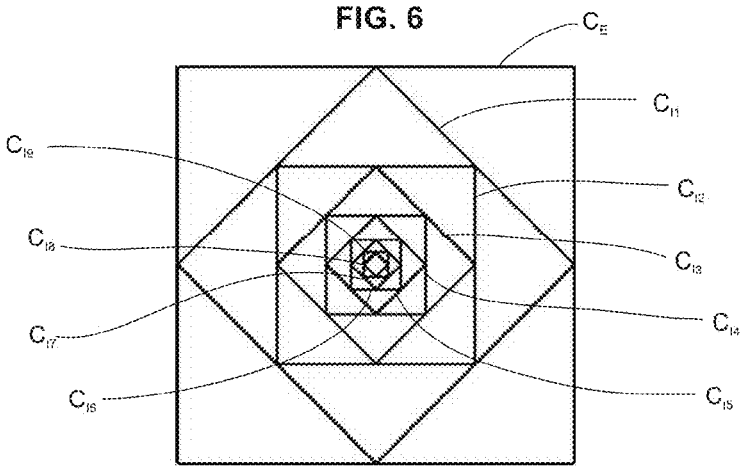
FIG. 6 is a horizontal cross-sectional view of the structure shown in FIG. 5 in the assembled position.

In the embodiments of the invention shown in FIGS. 1, 5, and 6, all the quadrangular faces of each internal and external compartment are square. The borders or sides of the side face, bottom face and cover face of the external compartment CE have a length L, so that, in the assembled state, the articulable structure forms a cube, the height, width and depth of which have the same length L. The borders or sides of the side face FL, bottom face FF and cover face FT of the internal compartments $C_{I1}$, $C_{I2}$, $C_{I3}$ . . . , $C_{IN}$ have a length Li shorter than or equal to $$\frac{L}{(\sqrt{2})^N}.$$

If one uses a shorter length Li, space will be left between the length $C_{IN}$ and the compartment $C_{I(N-1)}$ when the second one is fitted within the first one. In case a length Li equal to $$\frac{L}{(\sqrt{2})^N}$$

is used, the compartment $C_{IN}$ may be tightly fitted within the compartment $C_{I(N-1)}$, with an angular displacement of 45 degrees, as shown in FIG. 6.

As you can see from FIGS. 5A, 5B, 5C, 5D and 5E, the innermost packages may be connected to the outermost packages by means of any of their triangular faces, which may also be linked to any one of the side faces of the outermost compartments, as long as the proportion relations and other characteristics described herein are met.

The package according to the invention may be formed by a single plane piece in the disassembled state, from materials such as papers of different weight in grams per square meter, cardboard, plastic, polymeric, transparent or opaque, rigid or semi-rigid, patterned or plain materials, or still rubbered materials, foams, among others. In the cases where the material has flexibility, the connections and articulated links and joints are preferably formed by folds in the single piece. This makes the package extremely cheap and easy to manufacture, and it is sufficient to cut and crease the single piece in the shapes shown in the figures.

It is also possible to manufacture the package in accordance with the invention from rigid and resistant materials such as wood, plastics and metals, or still resistant but less rigid materials such as Paraná paper. In these cases, the articulated connections and joints are formed by hinges. The package may be closed by means of a magnet, by pressure, by male-female closure, Velcro or any other type of connection. The package faces may be magnetic, improving its resistance and facilitating the handling of the package. These coupling types can be used for both closing the package and for coupling the structure faces in any other way. The activation of the articulated connections of joints may be made in automated manner, and the automatic activation may be made remotely.

The package may be coated, both internally or externally, with fabric, may receive any imprints, reliefs, may be coupled to additional pieces and/or undergo any type of adaptation of shape or surface coating to adapt it to the purpose for which it is applied, as will be described in greater detail later with reference to FIGS. 12 to 21.

In the embodiment of the invention shown in FIGS. 9 to 11, the external compartment has additionally a pedestal that is located within the external compartment $C_E$, in the assembled state, being arranged beneath the internal compartment $C_{I1}$, as shown in FIGS. 11A and 11B to support its weight. This pedestal 4 provides horizontal support to the internal compartment $C_{I1}$, which, instead of hanging and so forcing the package structures, rests on its support face A. The use of this pedestal is advisable in situations in which heavier pieces kept inside the internal compartment would tend to deform it, forcing it downward and occupying the empty space between the internal bottom of the external compartment $C_E$ and the external bottom of the internal compartment $C_{I1}$. This empty space may be better observed in FIG. 2B, which illustrates an embodiment of the invention without pedestal. In FIGS. 11A and 11B, one can observe the pedestal in said empty space between the two compartments, supporting the internal compartment $C_{I1}$, which is no longer loose.

The pedestal 4 has the support face A, which is arranged horizontally, when in the assembled state, and on which the bottom face FF of the internal compartment $C_{I1}$ rests. The support face A may be square and may have smaller dimensions than the bottom face FF of the external compartment $C_E$, so that it will fit into the latter, and may be offset by an angle of 45 degrees with respect to the external compartment. In the embodiment of the invention illustrated in the figures, the support face A has the same dimensions as the bottom face of the internal compartment $C_{I1}$.

Figure 9A:
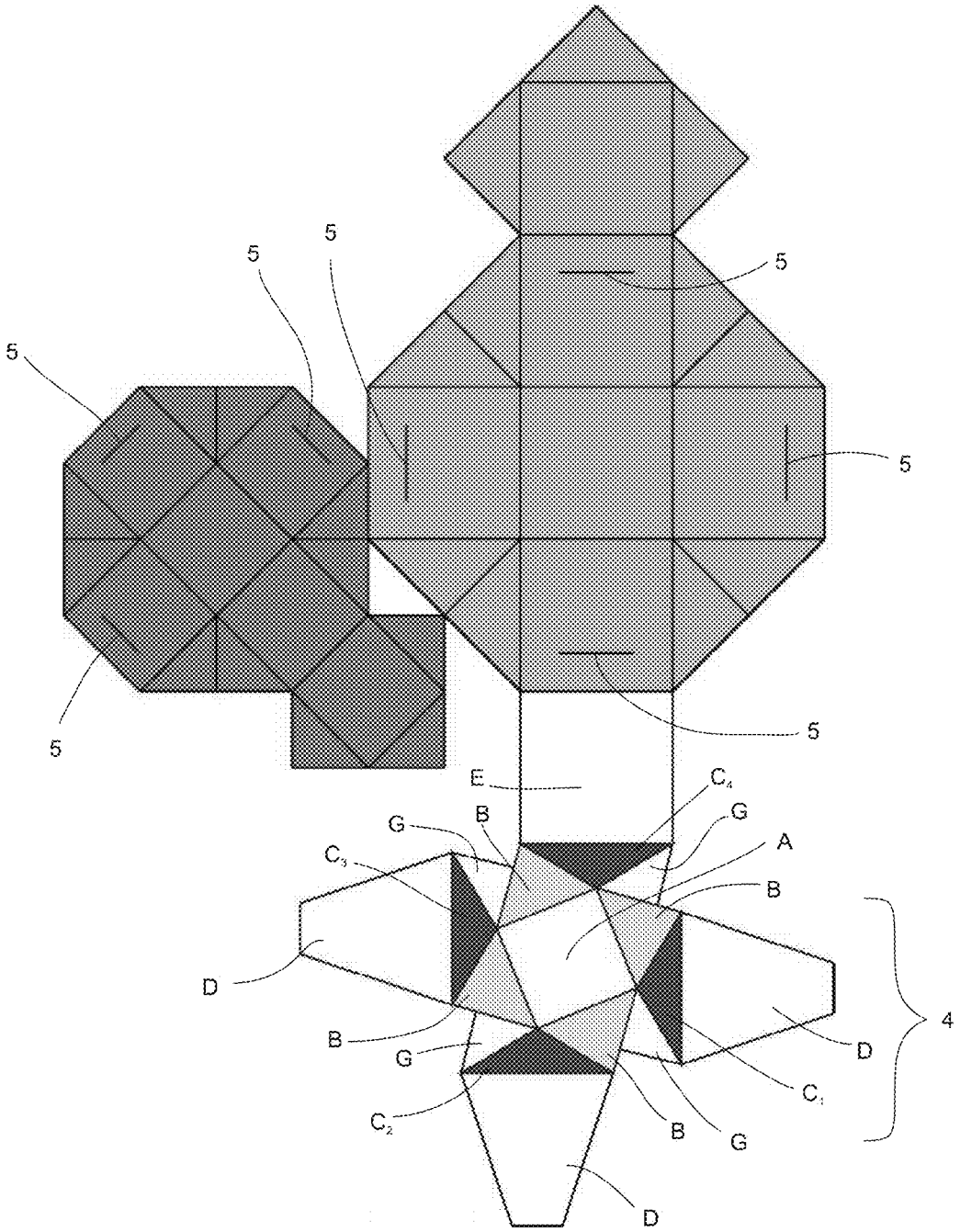
FIG. 9A is a top view of fourth embodiment of the structure according to the invention in the delineated position, having a support coupled to it.
Figure 9B:
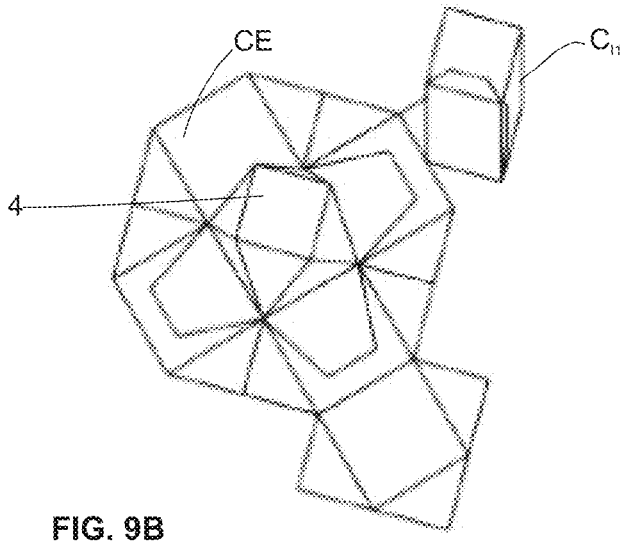
FIG. 9B is a perspective top view of the fourth embodiment of the structure, with the pedestal in the assembled position, and the other compartments in the open position.

Each of the four side borders of the support face A is articulately connected to a respective side triangle B of the pedestal, which will aid in supporting the pedestal. Thus, the pedestal has a total of four side triangles B, which, in this embodiment of the invention shown in these figures, are equilateral triangles. Each of these side triangles B is articulately connected at one of its edges to a respective base triangle C1, C2, C3 or C4. The pedestal has also a total of four base triangles C1, C2, C3, C4, which may be isosceles triangles and also aid in supporting the support face A, these base triangles C1, C2, C3, C4 being connected to the side triangles B by one of their sides of equal length. Three base triangles C1, C2, C3 are articulately connected, each to a border of a respective support trapeze D. The connection of each base triangle C1, C2, C3 with the respective support trapeze D is made by means of a larger edge of the base triangles, opposite its angle that is linked to the support face A, as shown in FIG. 9A. The fourth base triangle C4 is articulately connected to a border of a square connection face E, which is responsible for making the connection between the pedestal 4 and the external compartment $C_E$. In this case, the connection face E should have dimensions equal to the side face FL of the external compartment $C_E$, so that it can be folded into it, positioning the pedestal in the bottom of this compartment $C_E$. For this purpose, the connection face E is articulately linked, by a border opposite the base C4, to an upper border of the side face FL of the external compartment $C_E$. Besides, each base triangle C1, C2, C3, C4 is also articulately connected, by another edge, to an edge of a folding triangle G, which closes the assembly, having a merely esthetic finish function. The pedestal then has four folding triangles G, which, in the assembled state, are folded inward, running beneath the support face A, contributing to close it. In this way, the pedestal comprises four successive triangle sequences formed by a side triangle B, a base triangle C1, C2, C3, or C4 and a folding triangle G in clockwise direction, arranged around the support face A.

Besides, as shown in FIG. 9A, each of the side faces FL of the external compartment has, in this case, a cut-out 5, into which the end of a trapeze D fits when the package is in the assembled state and with the pedestal mounted inside the external compartment. In this case, it is necessary that only three side faces FL should be provided with the cut-out 5, for the respective engagement of the three trapezes (not illustrated version). This is because, when the pedestal is mounted inside the external compartment, the trapezes are folded upward in an angle such that its free ends meet with the cut-out 5 of the side faces, fitting into it and having the possibility of passing through the respectively side face and extending itself outward the external compartment. These cut-outs 5 can also be sued for engaging the triangular flaps 21, 22, and 23 of the cover face FT, providing more secure closure of the package. In this case, one can provide four cut-outs 5, one at each side face, for engaging the three flaps and the three trapezes, as shown in FIG. 9A.

Figure 9C:
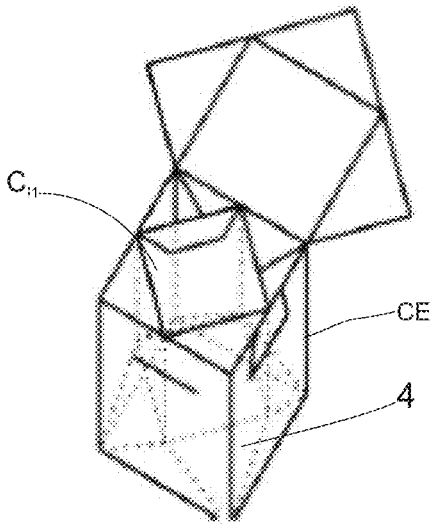
FIG. 9C is a schematic perspective top view of the fourth embodiment of the structure with the pedestal and the compartments in the assembled position, showing the arrangement between the pedestal and the internal compartment within the external compartment.

Besides the fold of the trapezes D, in order to mount the pedestal it is also necessary to fold the side triangles B downward with respect to the support face A, and to fold the base triangles C1, C2, C3, C4 also downward with respect to the side triangles to which they are articulately connected. This causes each base triangle C1, C2, C3, C4 to come close to the side triangle B of the next sequence of triangles in the clockwise direction, until their edges meet. With this approaching movement of the base triangles C1, C2, C3, C4 with respect to the side triangles B of the next sequence, the folding triangles G, equally folded inward, run beneath the support face A, bringing about the closure thereof. After this folding process, the pedestal takes on the shape illustrated in FIG. 9B, providing stable support for the internal compartment $C_{I1}$. FIGS. 11A and 11B also show the pedestal supporting the internal compartment $C_{I1}$ in cross-sectional views. FIG. 9C shows, in perspective schematic view, the arrangement of the pedestal 4 within the external compartment $C_E$, and with the internal compartment $C_{I1}$ resting on it. The dashed lines show the faces of the internal compartment and of the pedestal that would not be seen from the outside of the external compartment.

Figure 26:
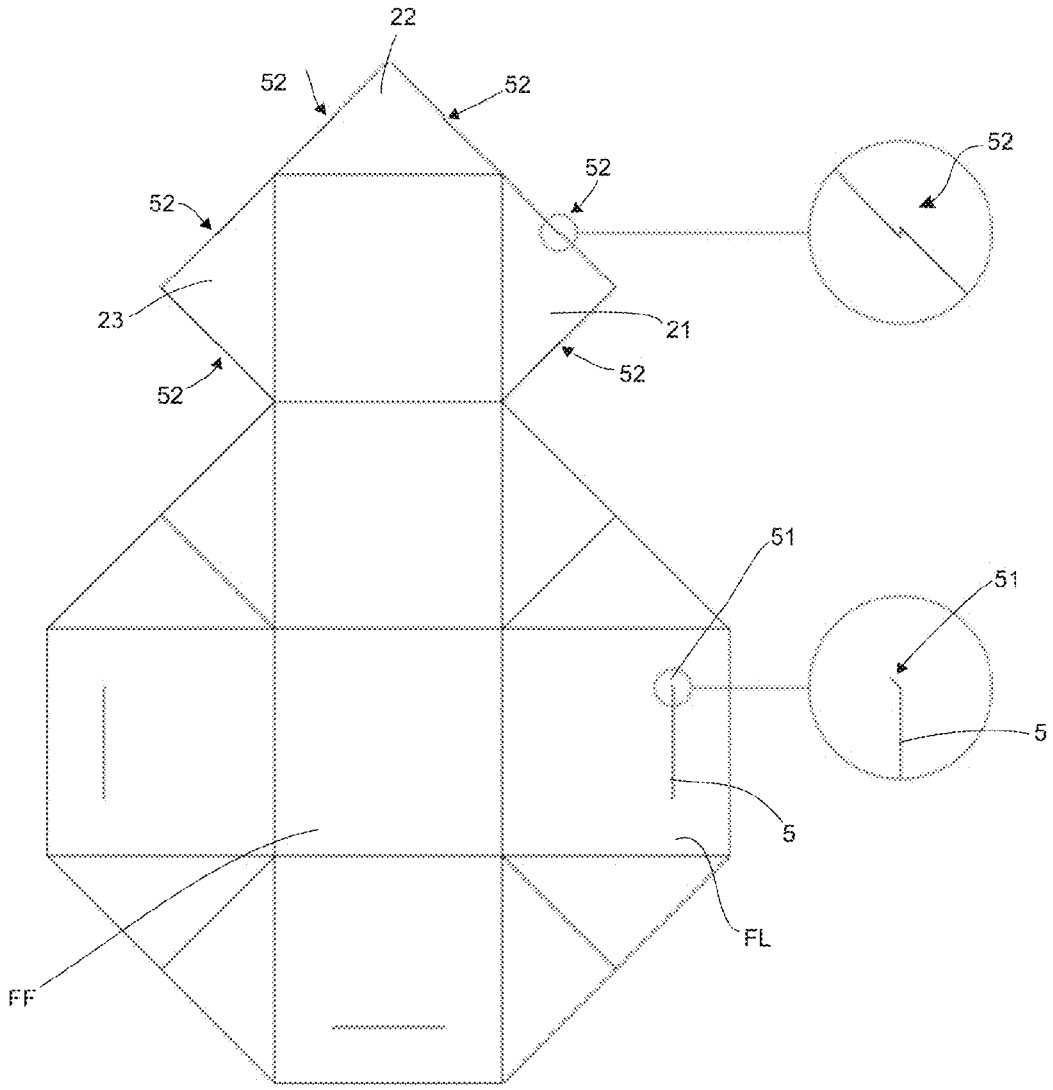
FIG. 26 shows an embodiment of the structure of the present invention provided with cover locks.

In the cases in which this is necessary for closing the package properly, for instance when it is made from polypropylene, the cut-outs 5 located at the side faces FL may be provided with locks 51 at their ends to provide even firmer fixation of the triangular flaps 21, 22, 23. As shown in FIG. 26 and mainly in the lower detail, these locks of the cut-outs 51 consist of a prolongation under obtuse angle from each one of the ends of the cut-out 5 toward the bottom face FF. The triangular flaps are also provided with locks 52. As can also be seen in the detail of FIG. 26, the flap locks 52 in this embodiment of the invention are constituted in the form of a saw tooth at each side edge of the flaps, at the point where the side edges cross the cut-outs 5, so as to engage the cut-out locks 51, when the structure cover is closed. The locks may assume any other shape than saw tooth, including a rounded shape, as long as it is capable of coupling to the cut-out locks 51. This engagement provides an even safer fixation of the cover face FT with the rest of the structure, chiefly when the structure is made from a material that has some kind of memory. According to an embodiment of the package shown in FIGS. 21A and 21B, two identical external compartments $C_{E1}$, $C_{E2}$ are provided, each of which being connected to an internal compartment. These internal compartments may be connected to other internal compartments of smaller dimension, and so on. A linking compartment $C_L$ shaped like the external compartments is still connected between the two external compartments $C_{E1}$, $C_{E2}$, so that each external compartment has a side face FL with an upper border connected articulately to an upper border of a side face FL of the linking compartment $C_L$. The side faces FL of the linking compartment connected to the external compartments should be diametrically opposed, so that, in the assembled state, each external compartment will be located on one opposite side of the linking compartment $C_L$. Besides, the linking compartment $C_L$ comprises two straps, each one attached to the upper border of one of its free side faces. In other words, the compartment may be provided with two straps attached to opposite side faces of the linking compartment $C_L$, so that, in the assembled state, the two straps will be arranged face to face and can be carried together.

FIGS. 24A to 24E illustrate the structure according to the invention with three different types of strap. The structure of FIG. 24C has only one strap 40 attached to the upper border of one of the side faces of the external compartment, which will engage the cutting line 5 of the opposite face FL. This structure requires closure of the cover face FT and of its respective three flaps. FIGS. 24A and 24B show the structure using the straps 30, which are of semi-oval and semi-circular shape, respectively. The straps 30 are attached to the upper border of diametrically opposed side faces. FIGS. 24D and 24E illustrate the process of assembling the structures with the aid of the straps. The left images illustrate the structures in the delineated shape with a central crease 20 that enables one to assemble it rapidly. The right images show the packages folded at the central crease 20 during the assembling process. The straps of the structures of FIGS. 24A and 24B are attached to the structure by their two ends, which provides greater resistance and dispenses with the need to assemble and fit them. Preferably, in the embodiments of FIGS. 24A and 24B, the triangular faces T are glued or welded, so that they can be assembled, which provides stability and rigidity required for the structure.

Figure 31A:
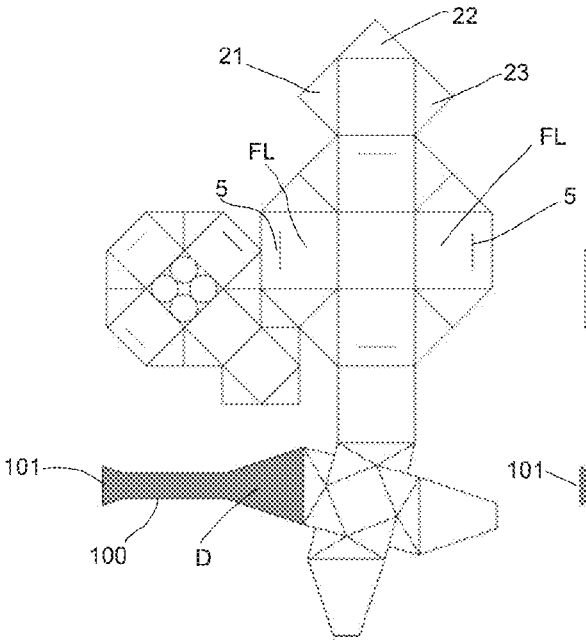
FIGS. 31A and 31B show another embodiment of the structure in the delineated form with a pedestal and a strap.
Figure 31B:
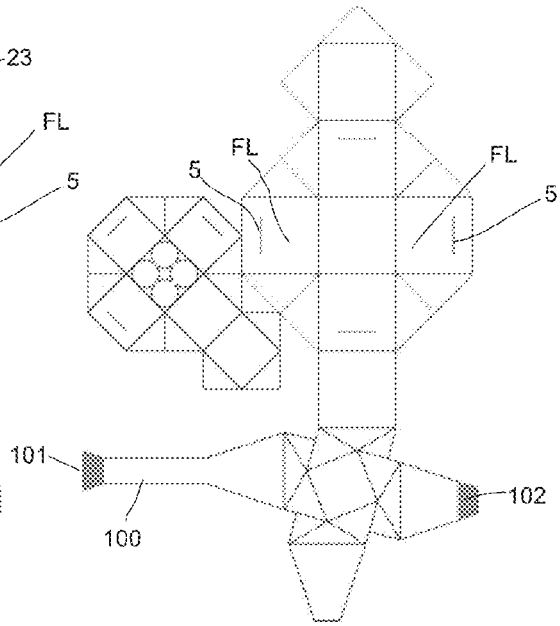
Figure 32A:
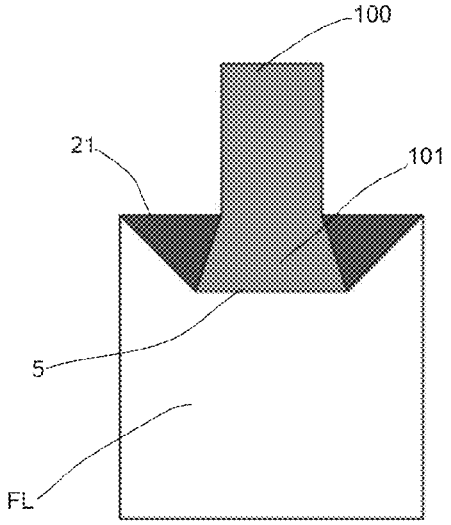
FIGS. 32A and 32B show, respectively, a side view and a front view of the embodiment of the structure shown in FIGS. 31A and 31B in the assembled form.
Figure 32B:
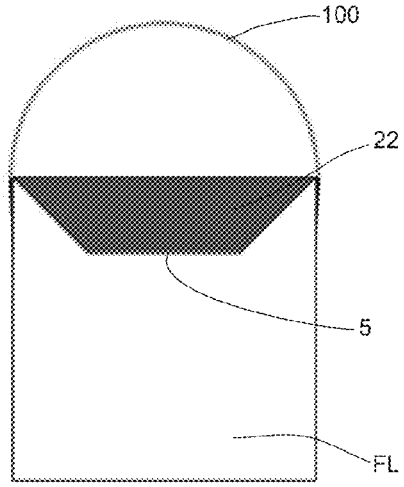

FIGS. 31A and B and 32A and B illustrate another model of structure provided with straps. This model is associated to the structure, which uses a small internal pedestal 4 of the type shown in FIGS. 9 to 11. The strap extends in the form of a strip 100 from one of the support trapezes D of the pedestal, as shown in FIG. 31A, which shows a delineated top view of the structure. When the structure is assembled, the strip 100 goes through a cut-out 5 of one of the side faces of the outermost compartment, since it is arranged overlapping the cover face, and its end 101 again gets into the external compartment from a cut-out 5 of the side face FL opposite the side through which it has gone to the exterior of the compartment, as can be seen in side and front views shows in FIGS. 32A and 32B. For secure attachment of the strap, when in the assembled state, its end 101 opposite the support trapeze D has a larger width and should be glued to the end 102 of the support trapeze D opposite the trapeze from which it extend, as can be seen in FIG. 31B.

Figure 22:
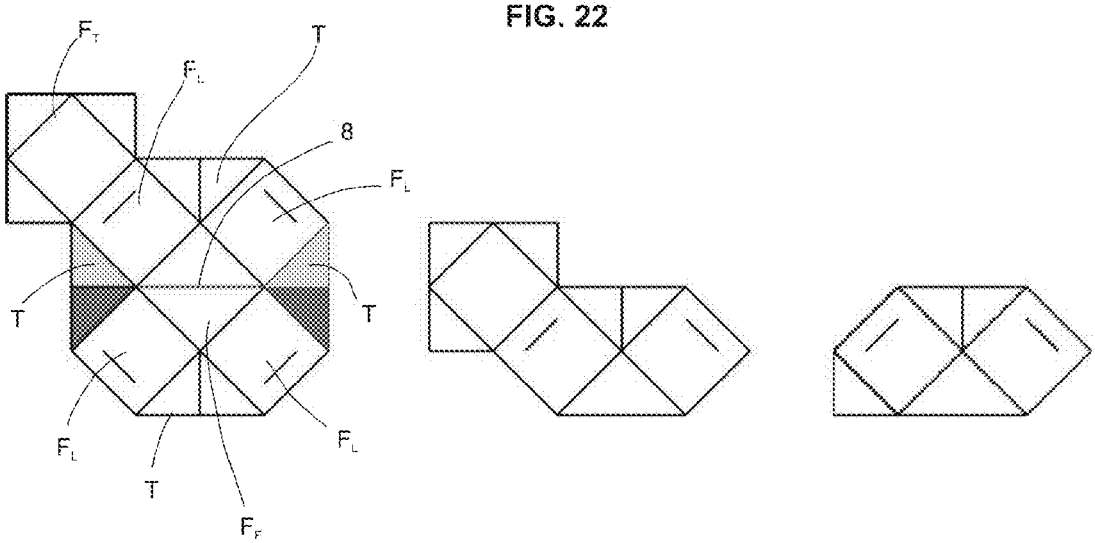
FIG. 22 shows a sequence of assembling steps of the articulable structure in the form of a fractal according to the invention forming a fractal cube, in the embodiment in which the bottom face is provided with a fold.
Figure 23:
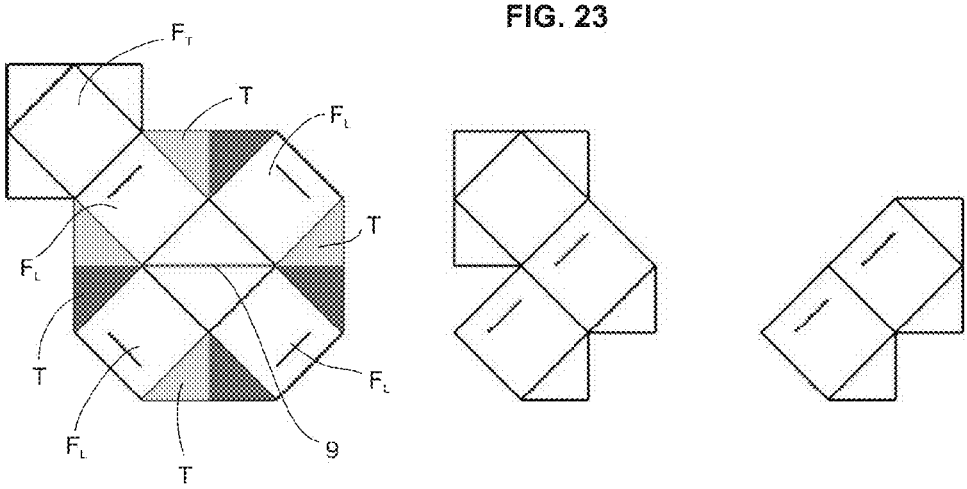
FIG. 23 shows a sequence of assembling steps of the articulable structure in the form of a fractal according to the invention, forming a fractal cube, in the embodiment in which the bottom face is provided with a cut-out.

FIGS. 22 and 23 show a way of using the package of the invention adapted for use in establishments that have a high sale volume, such as food stores, and so it is important that the package should occupy little space and can be rapidly assembled with fewer movements. Although these figures illustrate only the external compartment, the same physical characteristics and folding procedures can be used analogously for the internal compartments as well, since they have the same shape as the external compartment. The representation of FIGS. 22 and 23 has been simplified only to facilitate the understanding.

FIG. 22 shows an embodiment of the invention in which the external compartment is provided with an articulation that may be in the form of a fold or crease at its bottom face along the diagonal line 8, according to the image on the left. In order for the package to be rapidly assembled, it is necessary that the two triangles T that touch the ends of the crease line 8 should be folded by half and glued, or their hypotenuse should be welded to each other. In this way, it is enough to fold the external compartment in the middle along this diagonal line 8 according to the central image, and then to fold the cover face FT backward or forward, according to the image on the right.

FIG. 23 shows an embodiment of the invention in which the bottom face FF of the external compartment is provided with a cut-out 9 in the direction of one of its diagonals. In this case, all the triangular faces T should be either glued or welded. Thus, one folds the triangular face T in the middle and then unites the two halves of each of these triangular faces. The two triangles formed by the central face divided by cut-out 9 are projected downward when they are pressed, and displace laterally, as shown in the central image. Then, one folds the cover face FT either backward or forward, according to the image on the right. In this embodiment of the invention, it is necessary to couple to the bottom face some type of support or the pedestal 4 itself, shown in FIGS. 9 to 11, when in the assembled state, to prevent the contents from coming out of the package bottom, and providing it with greater rigidity.

In some embodiments of the invention, one of the internal compartments may remain static in the form of a monoblock, as for instance in the application shown in FIG. 15, which will be described in greater detail later.

The package of the present invention may be employed for varied uses. One first form of utilization would be as a multi-use package, which both makes it valuable and protects the products kept inside it, and it may also be conjugated to materials that absorb impacts and/or that fill the resulting empty spaces between the external compartment and the internal compartment, making the assembly even more resistant. The package can be used as a case for presents such as jewels, crystals, chinaware, undergarments, children's clothes, among a variety of products, electronic equipment, cellular phones, iPad, iPhone, etc.

Figure 8:
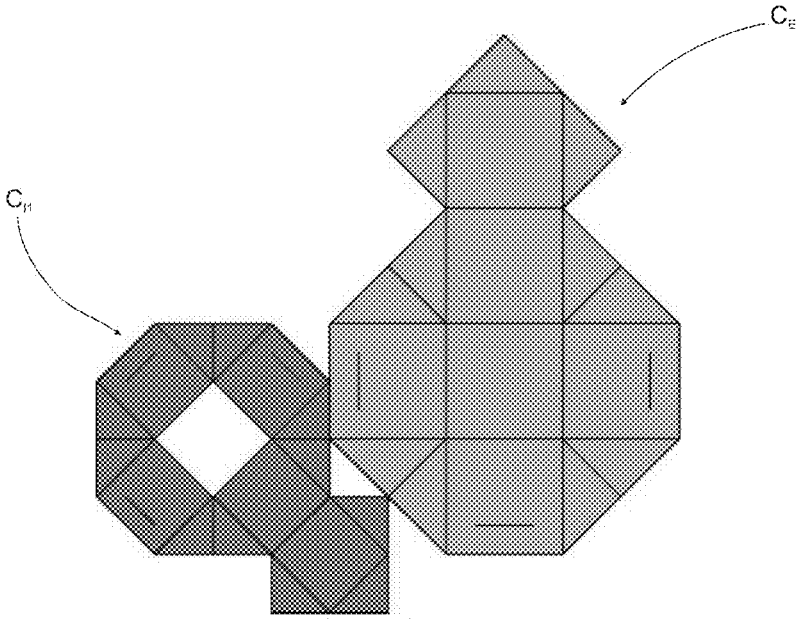

Another possible form of utilization is as a package for food products, such as biscuits chocolates, or still as beverage package containing wine and vodka bottles, aluminum cans, cardboard packages for fruit juice or milk, PET bottles. The package shown in FIG. 8, for instance, can be used for packing beverage bottles. In this embodiment, the internal compartment does not have the bottom face, which forms a recess within it, where the bottle can be arranged in a firm and secure manner, with the bottom resting on the bottom face of the external compartment, and with its body resting on the side faces of the internal compartment.

Figure 25:
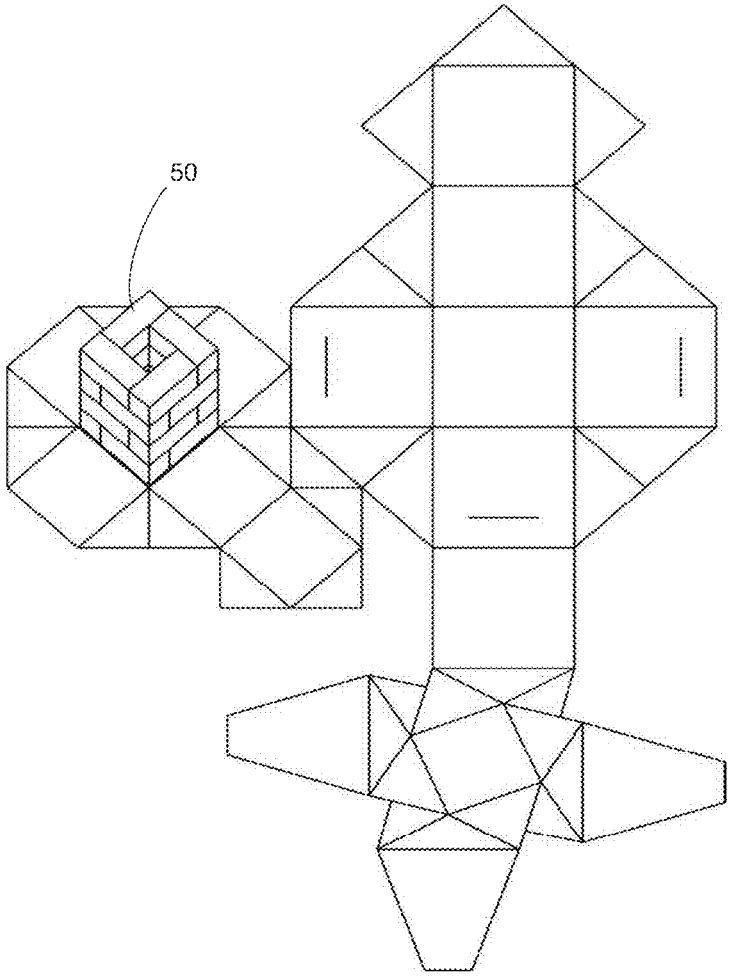
FIG. 25 shows an embodiment of the structure of the present invention in the form of a promotional box.

The structure according to the invention can function as a multipack package, and can hold small cans, PET bottles, cardboard packages, among other things. In an embodiment of the invention, one can provide a promotional box of 16 200-ml cardboard packages 50 intended for children, shown in FIG. 25. In this case, the packages could be arranged 4 to 4, configuring an internal space where toys or other promotional pieces (such as characters, data, accessory, etc) can be kept, as the packages in the delineated form can be chanted into a game board. The smaller compartment too may be used as a roulette, if the game requires this.

The package can be used for various games, functioning as a game board. For example, as one goes on to the next phase, the cube opens and the player reaches a new board (level), and this will evolve as the internal compartments are provided to the package. In the delineated state, the package can also serve as a support for telling stories about the characters in a game, for instance, by putting the description of each character on one of the inner or outer faces of the internal or external compartment. This form of package with descriptions on its inner and/outer faces can function as a book to be read from outside in, or else a book containing origami fixed to its pages, which get assembled when the pages are opened. The package can also be used as a simple mathematical object of the fractal type, or as another type of educational object, where letters and numbers could be printed on its faces, so as to aid in the learning and teaching processes, aiding in the motor development of children. It can further be used as a children's toy, a creativedice, a creative safe with numberless keys, a portrait holder, with each face bearing one or more pictures, among others. In these and in other cases, the structure may be made from coated Paraná paper—or a similar paper having a high weight in grams per square meter, which imparts greater resistance.

FIGS. 27A to 27E show an embodiment of the invention in which the package faces are made in different thicknesses. In this embodiment, the side faces FL and bottom face FF should have double the thickness of the flaps 21, 22 and 23. Besides, recesses R are formed at the side faces FL, in the coupling region of the flaps 21, 22, 23. These recesses R are inner portions of the side faces FL having the same shape, adjacent the outer border of each side face, and which exhibit half the thickness of the rest of the face. These recesses enable one to fit or house the flaps inside them, when the structure is in the assembled position and the cover is closed.

Thus, the engagement between the flaps 21, 22 and 23 and the side faces FL may be made by means of a male-and-female system, by Velcro, magnets, among others. This embodiment of the invention is preferably used when the structure is made from rigid materials such as metal, plastic and wood, provided with hinges, wherein the flaps cannot be fitted into cut-outs in the side face.

In the application of the invention shown in FIG. 12, the package containing an external compartment and an internal compartment is used for keeping objects of the type CD's, DVD's or even books. These objects are arranged within the innermost compartment. The empty space within the external compartment may be used for keeping other objects. Or still one may use the package version that uses the pedestal 4, to aid in supporting these heavier objects. When used for keeping books, the package may be configured so as to house any formats, including the three most usual edition formats: 18×18 cm, 14×21 cm and 16×23 cm, the last two rectangular formats being of the type shown in FIG. 7.

The package may also be employed to aid in organizing personal objects, for example, by using the smaller internal compartments for keeping equally small objects such as cellular telephones, MP3 player, keys, documents, credit cards, pen drives, jewel cases, among others.

In a possible application, the package may be used as a promotional an advertizing box, which will play the role of advertizing and informative folder for delivery of credit cards by the operating companies to their clients. The internal compartment may be provided with a support for securing the credit card, and may have a security sealing system. Besides the fact that a compartment within another makes the package more secure, some additional systems that aim at greater protection may be adopted, such as detachable fitting flaps, obliging people to tear open the package, which will prevent it from closing again perfectly, facilitating the control by the client with regard to mail violation.

Figure 13:
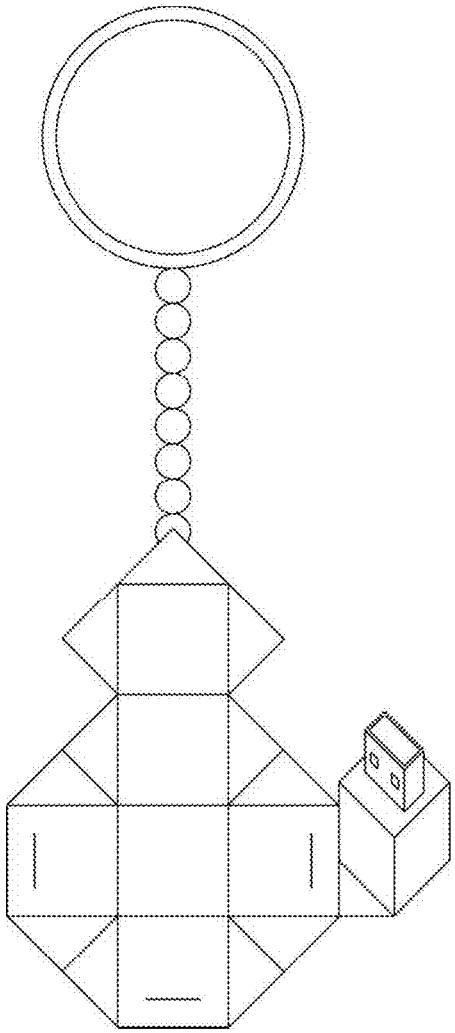
FIG. 13 is a top view of sixth embodiment of the articulable structure in the form of a fractal according to the invention in the delineated position, having a key-ring chain attached to its cover and a pen drive in its internal compartment.

FIG. 13 illustrates a package embodiment that is used in association with a pen drive, wherein the internal compartment has a USB connection. The internal compartment is connected to a chain, constituting a key-holder.

Figure 14A:
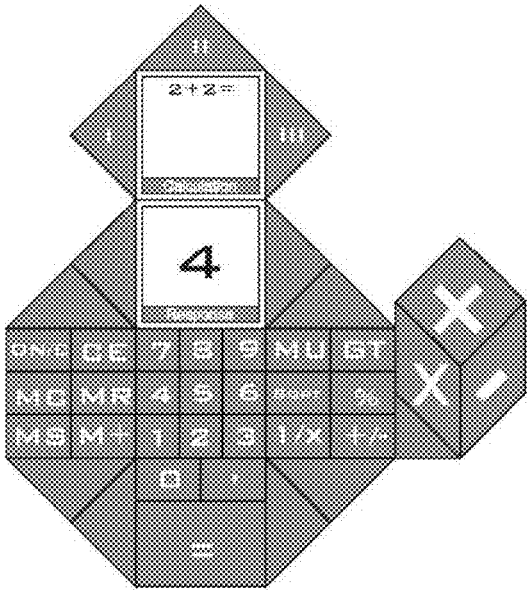
FIGS. 14A and 14B are top views of two versions of seventh embodiment of the articulable structure according to the invention in the disassembled position, in the form of a calculator.
Figure 14B:
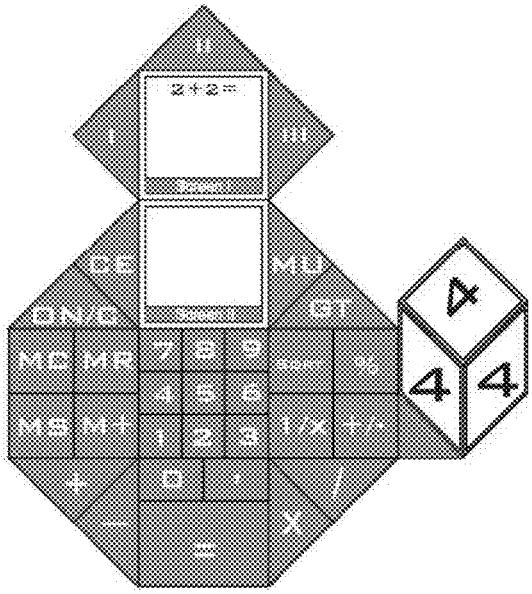

FIGS. 14A and 14B illustrate two variants of the embodiment of the invention in which the package is also used as a calculator, in which the keys may be organized in various arrangements, as shown in these figures. In the embodiments shown as examples, the internal compartment would not open and might both be a screen on which only the results of the operations (FIG. 14B) would appear and have, on each of their faces, a function, multiplication, division, addition and subtraction (FIG. 14A).

Figure 15:
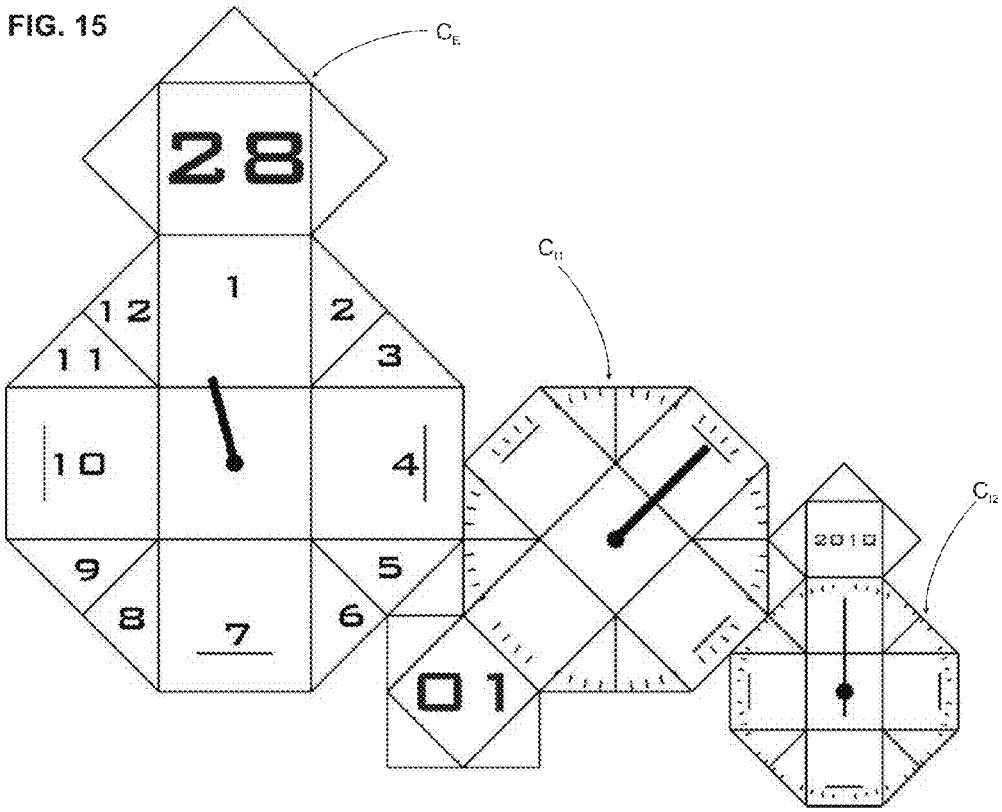
FIG. 15 is a top view of eighth embodiment of the articulable structure in the form of a fractal according to the invention in the delineated position, functioning as a clock showing hours, minutes and seconds.

FIG. 15 shows an embodiment of the invention in which the package is also used as a wall clock. The inner bottom face of the external compartment shows the hours, the inner faces of the first internal compartment $C_{I1}$ shows the minutes and the inner faces of the second innermost compartment $C_{I2}$ shows the seconds. For this purpose, clock-hands are provided on the bottom faces of each compartment. Besides, the inner cover face of the external compartment CE shows the day, and the inner cover faces of the modules $C_{I1}$ and $C_{I2}$ show month and year. In this case, the package serves as a support and may or may not be folded.

Figure 16A:
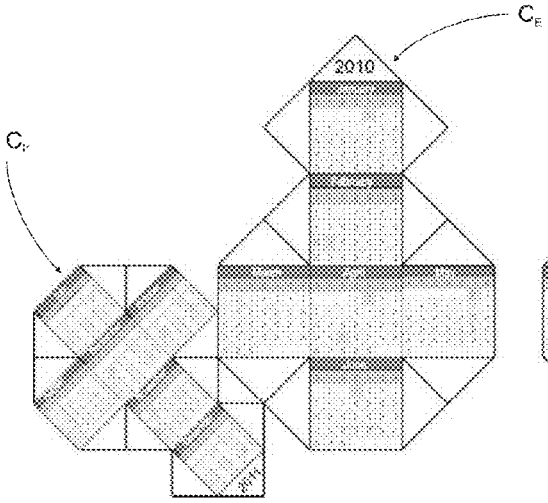
FIGS. 16A and 16B are top views of two versions of ninth embodiment of the articulable structure in the form of a fractal according to the invention in the delineated position, in the form of a calendar.
Figure 16B:
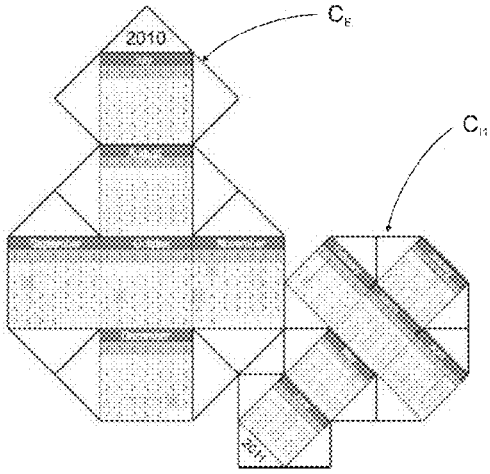

FIGS. 16A and 16B show two variants of the embodiment of the invention, wherein the package is also sued as a calendar that may be composed in different ways in addition to those shown herein. In these figures, one external compartment and one internal compartment are used, and a month of the year is printed on each square face of the compartment. One may put the 2-year calendar in the same package, using the inner and outer faces. One may also use an external compartment and five internal compartments, the whole inner side of each compartment containing a month.

Figure 17:
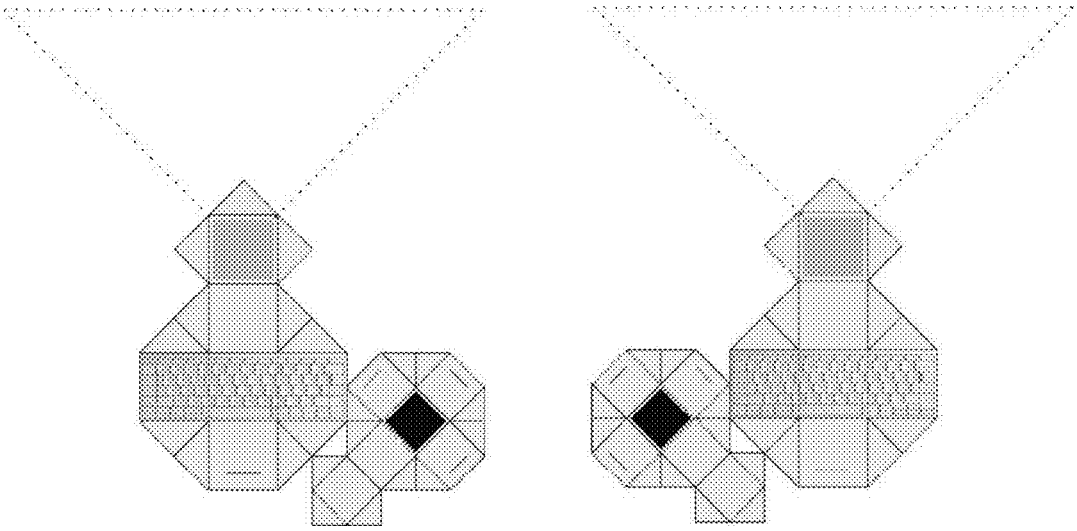
FIG. 17 is a top view of tenth embodiment of the articulable structure in the form of a fractal according to the invention in the delineated position, functioning as a keyboard and a mouse for computers.
Figure 18:
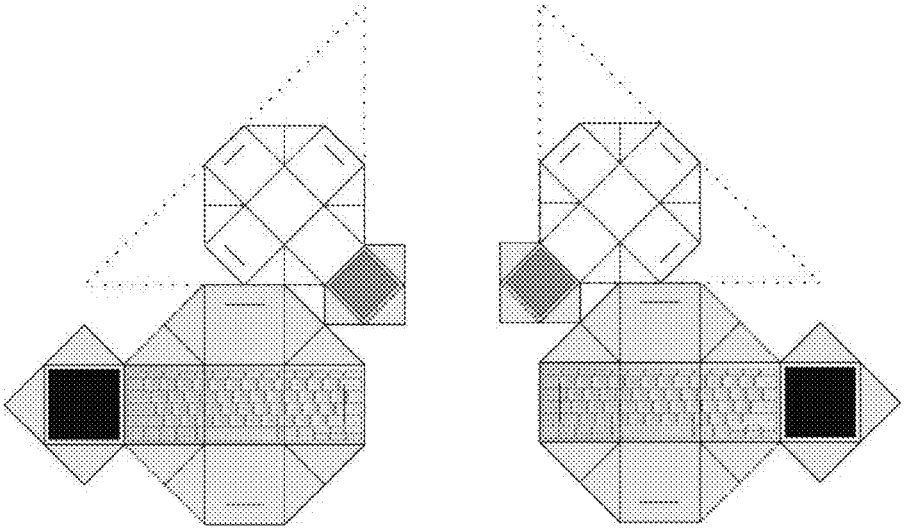
FIG. 18 is a top view of eleventh embodiment of the articulable structure in the form of a fractal of the invention in the delineated position, in the form of a keyboard, a mouse and a monitor for a computer.

FIGS. 17 and 18 show two variants of the embodiment of the invention in which the package is used as a personal computer of the notebook type. In the embodiment shown in FIG. 17, the internal compartment having the function of an integrated mouse. In the embodiment illustrated in FIG. 18, the smaller compartment is used as a protection screen to replace a computer monitor. In both cases of FIGS. 17 and 18, the external compartment has a computer keyboard on its inner faces. The outer faces of the package, besides being resistant, may be photovoltaic, reloading the computer battery when the latter is not in use. Due to its geometric configuration, the computer may be adapted for both right-handed people and for left-handed people, with the monitor or the integrated mouse being arranged on the left or right side. Both models have a visual projection apparatus that replaces the conventional monitor. However, in the embodiment of FIG. 17, the image is projected, forming the screen on a wall that is external with respect to it, and in the embodiment shown in FIG. 18 the image is projected on the screen formed by the smaller compartment in the open position.

Figure 19:
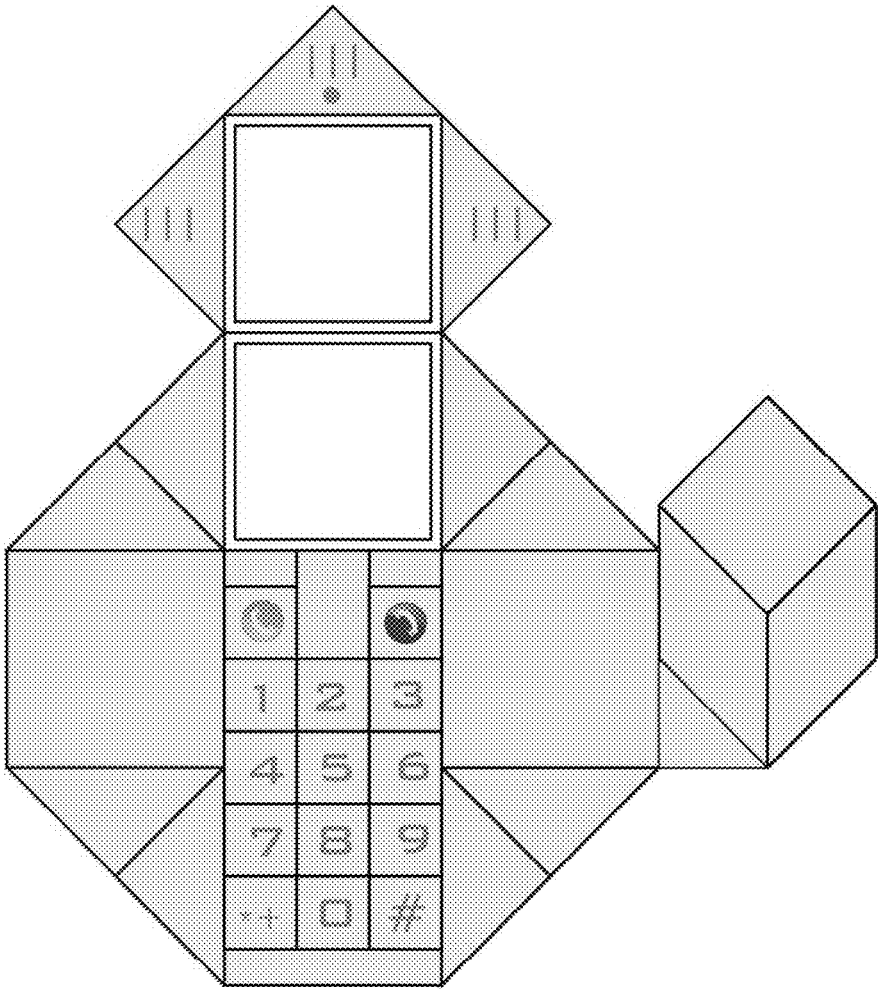
FIG. 19 is a top view of twelfth embodiment of the articulable structure in the form of a fractal according to the invention in the delineated position, in the form of a cellular telephone.

FIG. 19 shows an embodiment of the invention in which the package is used as a cellular telephone with two screens, one for the traditional use display and the other for webcam viewing, these screens being positioned on a side face and on the inner cover face of the external compartment. The cellular keyboard is located in the internal central region of the external compartment. The internal compartment constitutes or comprises a detachable battery, facilitating the loading of the cellular battery, since as a battery is being used the other might be loading.

Figure 20:
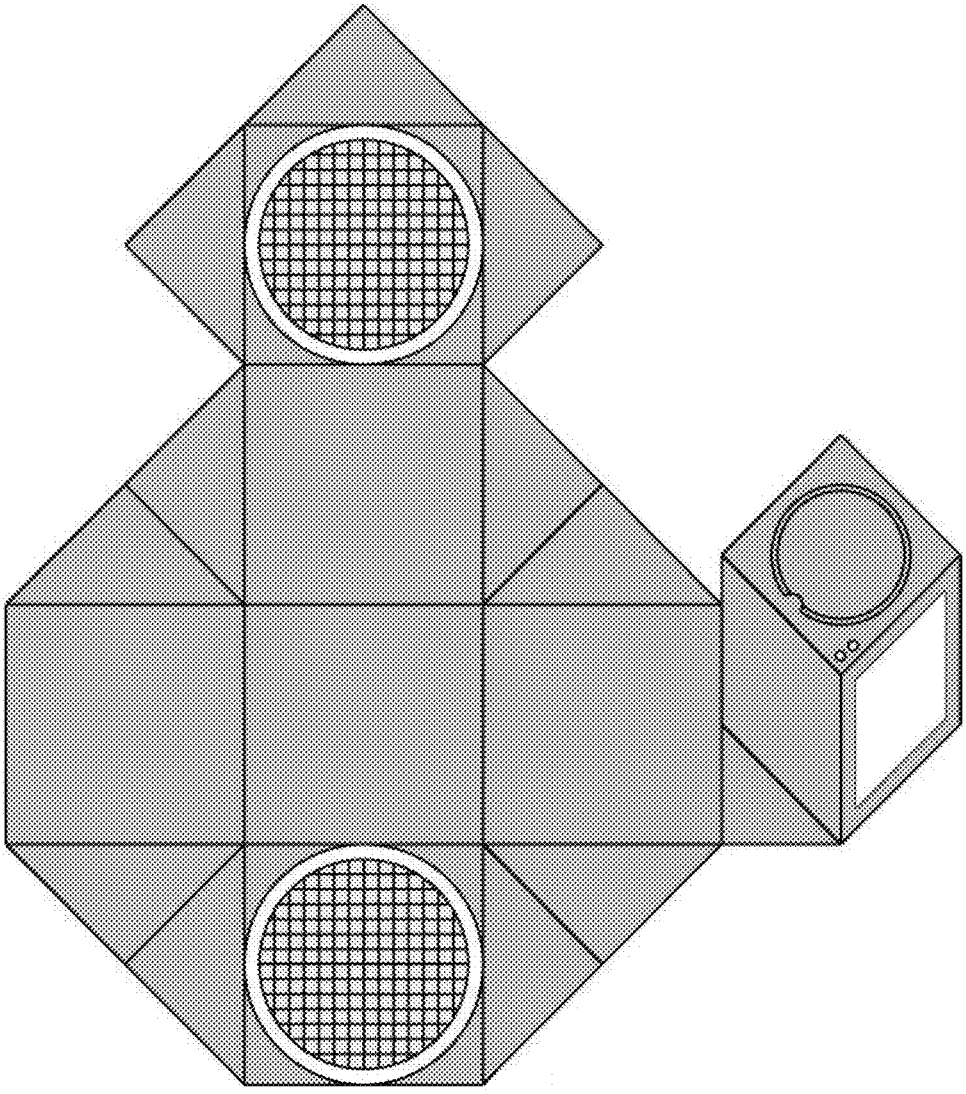
FIG. 20 is a top view of thirteenth embodiment of the articulable structure in the form of a fractal according to the invention in the delineated position in the form of a portable stereo apparatus.
Figures 21A, 21B:
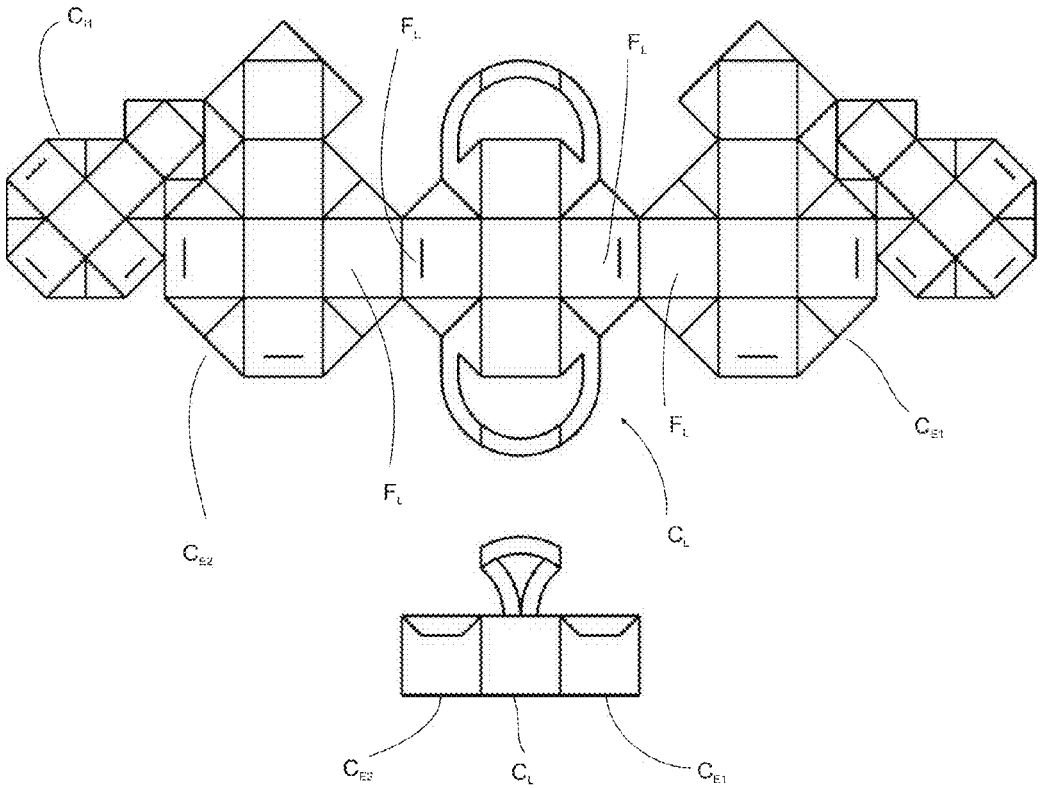
FIG. 21A is a top view of fourteenth embodiment of the articulable structure in the form of a fractal according to the invention in the delineated position, using two external compartments joined together by a joining compartment with two straps.
FIG. 21B is a view of the structure shown in FIG. 21A in the assembled position.

FIG. 20 shows an embodiment of the invention in which the package is used as a portable stereo, wherein the external compartment in the open position holds the sound boxes and the internal compartment is the apparatus proper.

Other forms of application of the package according to the invention that are not shown herein are also possible, such as in the form of a public telephony system, wherein people would only have access to the apparatus located in the innermost compartment after introducing the card or token, which would actuate an automatic opening system of the innermost compartment. In this way, one would prevent acts of vandalism, which are so common in big cities, damaging the apparatus and being detrimental to the population.

The package may also be applied as information totem electronic system, which would open and close by means of a password or security key. Since this system is moveable, as it is closed it would enable touristic information totems to be installed at places where, due to lack of security, do not have this type of service.

Depending on the resistance and rigidity of the material that constitutes the package, the latter may also be used as a collapsible and articulable piece of furniture, such as a bench or center table, by using rigid materials such as wood, metals, rigid polymers or others. The versions of rigid material are also applicable to sale stands in square shape, information panel that could open and close according to need, scenery for theater, dance or performances in which the dancer or actor might be within one of the package compartments and interact with it during the show.

The package may also be applied to other stationery, such as party cards for wedding and birthday dates, business cards, business folder or project disclosing folders, promotion inserts, among others.

The invention is further applicable to technological articles such as automated photovoltaic plates, which would have sensors applied to the inner faces and would function when the structure according to the invention would be delineated, the external compartment being resistant and could close when exposed to wind and weather, risk, or simply for protection, so as to protect all the sensors and pieces of higher value. On sunny days the package would open and could take on different sizes according to the amount of energy which one desires to capture. The invention may also be used as a solar cell at space and satellite stations, meeting the requirement of the space agencies for solar modules that can be folded, thus being protected in case of need in such a hostile environment like the outer space.

The invention may also be used as a portable television set, wherein the external compartment is open and the screen and the internal compartment may remain closed and contain a memory, a DVD player or any other accessory. Another form of using the invention in the same line is as a virtual projector, wherein the internal compartment would project on both the inner surface of the external compartment in the open state and on outer surfaces such as walls. The images could even be interactive.

Various preferred examples of embodiment having been described, it should be understood that the scope of the present invention embraces other possible variations, being limited only by the contents of the accompanying claims, which include the possible equivalents.

The invention claimed is:

1. An articulable structure in the form of a fractal, said structure comprising:

at least one external compartment ($C_E$) and at least one first internal compartment ($C_{I1}$) linked to each other articulately by at least one of their borders, wherein:

the at least two compartments ($C_E$, $C_{I1}$) have essentially the same shape in the assembled and delineated states;

the first internal compartment ($C_{I1}$) has smaller dimensions than those of the external compartment;

in the assembled state, the first internal compartment remains housed within the external compartment ($C_E$), and each compartment has a polygonal shape comprising at least four side faces (FL) and one bottom face (FF);

each structure compartment comprises at least five quadrangular faces corresponding to the four side faces (FL) and the bottom face (FF), each border of the bottom face (FF) being articulately linked to a lower border of equal dimensions of one of the side faces (FL); and each structure compartment comprises at least four equal triangular faces (T) in the form of isosceles triangle, each triangular face (T) connecting two neighboring side faces, each border corresponding to a cathetus of the triangle being articulately linked to a side border of one of the side faces (FL), and the border corresponding to the hypotenuse linking the vertices of the two neighboring side faces, wherein the length of the hypotenuse border of the triangular faces (T) of the first internal compartment ($C_{I1}$) is equal to or smaller than the length of the upper border of the side faces (FL) of the external compartment ($C_E$).

2. The articulable structure according to claim 1, wherein the half of the length of the hypotenuse border of one triangular face (T) of the first internal compartment ($C_{I1}$) is articulately connected to the half of the length of the upper border of one side face (FL) of the external compartment ($C_E$).

3. The articulable structure according to claim 1, wherein each triangular face (T) of each structure compartment has a central articulation (1) in the bisectrix line of its right angle that enables one to fold the triangular face into the structure, when in assembled state.

4. The articulable structure according to claim 1, further comprising a plurality of internal compartments ($C_{I2}$, $CI_3$, . . . , $C_{IN}$), wherein, in the assembled state each internal compartment ($C_{IN}$) remains housed within an immediately larger internal compartment ($C_{I(N-1)}$), each internal compartment ($C_{IN}$) having essentially the same shape in the assembled and delineated states as the immediately larger internal compartment ($CI_{(N-1)}$), wherein the length of the hypotenuse border of the triangular faces (T) of one internal compartment ($C_{IN}$) is equal to or smaller than the length of the upper border of the side faces (FL) of the immediately larger internal compartment ($C_{I(N-1)}$), and the half of the length of the hypotenuse border of one triangular face (T) of the internal compartment ($C_{IN}$) is articulately connected to the half of the length of the upper border of one side face of the larger internal compartment ($C_{I(N-1)}$).

5. The articulable structure according to claim 4, wherein all the quadrangular faces of each compartment are square, the sides of the side faces (FL) of the external compartment ($C_E$) having a length L, the sides of the side faces (FL) of the internal compartments ($C_{I1}$, $C_{I2}$, $C_{I3}$, $C_{IN}$) having a length $$\frac{L}{(\sqrt{2})^N}.$$

6. The articulable structure according to claim 1, wherein the structure is formed by a single plane piece in the delineated state, all the articulated connections and joints being formed by folds in the single piece.

7. The articulable structure according to claim 1, wherein the articulated connections and joints are formed by hinges.

8. The articulable structure according to claim 1, wherein the bottom face (FF) of at least one of the structure compartments has at least one of an articulation (8) or a cut (9) in the direction of one of its diagonals.

9. The articulable structure according to claim 1, further comprising two identical external compartments ($C_{E1}$, $C_{E2}$), each of which connected to at least one internal compartment ($C_{I1}$, $C_{I2}$, $C_{I3}$, $C_{IN}$), and one linking compartment (CL) with a shape similar to that of the external compartments, each external compartment having a side face (FL) with an upper border articulately connected to an upper border of a side face (FL) of the linking compartment (CL), the side faces of the linking compartment connected to the external compartments being diametrically opposed.

10. The articulable structure according to claim 9, wherein the linking compartment (CL) comprises at least one strap secured to the upper border of at least one of the free side faces of the linking compartment.

11. The articulable structure according claim 1, wherein each compartment ($C_E$, $C_{IN}$) of the articulable structure further comprises a sixth quadrangular face corresponding to the cover (FT) of the compartment, which has the same dimensions as the bottom face (FF), wherein one border of the sixth face is articulately connected to an upper border of one of the side faces (FL), and the cover face of each compartment comprises three flaps (21, 22, 23) in form of an isosceles right-angled triangle, each of the flaps being articulately connected by its hypotenuse to a free border of the cover face (FT).

12. The articulable structure according to claim 1, wherein the external compartment further has a pedestal that comprises a square support face (A) of smaller dimensions than the bottom face of the external compartment, wherein each of the four side borders of the support face (A) is articulately connected to a side triangle (B), each of the side triangles (B) is articulately connected, at one edge to a base triangle (C1, C2, C3, C4), wherein three (C1, C2, C3) of the four base angles are articulately connected to a border of a respective support trapeze (D), through an edge of the base triangle opposite to its angle that links to the support face (A), and the fourth base triangle (C4) is articulately connected to a border of a square linking face (E) equal to the side face of the external compartment, the linking face (E) is articulately linked, by a border opposite to the base triangle (C4), to an upper border of a side face (FL) of the external compartment ($C_E$), wherein each base triangle (C1, C2, C3) is also articulately connected, by another edge, to an edge of a fold triangle (G), wherein the four fold triangles (G) are articulable inward running downward of the support face (A), and each side face (FL) of the external compartment has a cut (5), into which an end of a trapeze (D) of the pedestal fits, as well as the three triangular flaps articulated to the cover face (FT), when the structure is in the assembled state and with the pedestal mounted inside the external compartment ($C_E$).

13. The articulable structure according to claim 1, further comprising at least one strap (30; 40) secured to the upper border of one of the free side faces (FL) of the external compartment ($C_E$).

14. The articulable structure according to claim 1, wherein the structure is configured in the form of a fractal in the delineated and assembled states, where in the shape of the external compartment ($C_E$) is successively reproduced in the internal compartments ($C_{IN}$) in the delineated and assembled states and, in the assembled state, the internal compartment ($C_{IN}$) is tightly fitted inside the immediately larger compartment ($C_{I(N-1)}$) with an angular displacement of 45 degrees, forming a multi-compartment package.

15. The articulable structure according to claim 11, wherein the side faces (FL) of the external compartment have a cut (5) in which the flaps (21, 22, 23) of the cover fit, the cuts (5) and the flaps (21, 22, 23) being provided with locks (51, 52) that engage with each other when the structure cover is closed, providing secure fixation of the cover face (FT) with the structure.

16. The articulable structure according to claim 11, wherein the side faces (FL) and bottom face (FF) have double the thickness of the flaps (21, 22, 23), wherein recesses (R) are formed internally in the side faces (FL) in the region of coupling of the flaps (21, 22, 23), the recesses (R) exhibiting the same shape as the flaps and half the thickness of the side faces, for engagement of the flaps into the recesses (R).

17. The articulable structure according to claim 12, further comprising a strap (100) that extends from one of the support trapezes (D) of the pedestal and, in the assembled state of the structure, the strap (100) goes through a cut (5) of one side face (FL) toward the outside of the outermost compartment ($C_E$), and the end (101) of the strap passes through another cut (5) of the opposite side face (FL), toward the inside of the external compartment ($C_E$), the end (101) of the strap being glued to the end (102) of the opposite support trapeze (D).

* * * * *